US011098532B2

(12) United States Patent
Gan et al.

(10) Patent No.: US 11,098,532 B2
(45) Date of Patent: Aug. 24, 2021

(54) CUTTING ELEMENTS HAVING NON-PLANAR SURFACES AND TOOLS INCORPORATING THE SAME

(71) Applicant: SMITH INTERNATIONAL, INC., Houston, TX (US)

(72) Inventors: Xiaoge Gan, Houston, TX (US); Anjie Dong, Spring, TX (US); Gerard Johnson, Houston, TX (US); Michael George Azar, The Woodlands, TX (US); Huimin Song, Spring, TX (US); Youhe Zhang, Spring, TX (US); Venkatesh Karuppiah, The Woodlands, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 159 days.

(21) Appl. No.: 16/121,694

(22) Filed: Sep. 5, 2018

(65) Prior Publication Data

US 2019/0071933 A1 Mar. 7, 2019

Related U.S. Application Data

(60) Provisional application No. 62/554,128, filed on Sep. 5, 2017.

(51) Int. Cl.

| | |
|---|---|
| ***E21B 10/567*** | (2006.01) |
| ***E21B 10/55*** | (2006.01) |
| *B22F 5/00* | (2006.01) |

(52) U.S. Cl.

CPC ..... *E21B 10/5676* (2013.01); *E21B 10/55* (2013.01); *E21B 10/5673* (2013.01); *B22F 2005/001* (2013.01)

(58) Field of Classification Search

CPC .. E21B 10/5676; E21B 10/55; E21B 10/5673; B22F 2005/001

See application file for complete search history.

(56) References Cited

U.S. PATENT DOCUMENTS 4,679,639 A * 7/1987 Barr ..... E21B 10/567 175/432
5,078,219 A * 1/1992 Morrell ..... E21B 10/12 299/111

(Continued)

FOREIGN PATENT DOCUMENTS

| | | |
|---|---|---|
| CN | 202380981 U | 8/2012 |
| CN | 202451062 U | 9/2012 |
| CN | 106703704 A | 5/2017 |

OTHER PUBLICATIONS

First Office Action and Search Report issued in Chinese Patent Application 201811030199.7 dated Apr. 16, 2021, 14 pages.

*Primary Examiner* — Aaron L Lembo

(57) ABSTRACT

A cutting element includes a body, a non-planar cutting face formed on a first end of the body, and an edge formed around a perimeter of the cutting face. The cutting face includes a central raised portion, and the edge has an edge angle defined between the cutting face and a side surface of the body. The edge angle varies around the perimeter of the cutting face and includes an acute edge angle defined by a portion of the cutting face extending downwardly from the edge to a depth from the cutting angle. The portion of the edge defining the acute edge angle may be directly adjacent: a side surface of the cutting element; a bevel of the cutting element; or a flat region at the perimeter of the cutting element or bevel.

20 Claims, 15 Drawing Sheets

(56) References Cited

U.S. PATENT DOCUMENTS

| | | | | |
|---|---|---|---|---|
| 5,460,233 | A * | 10/1995 | Meany | E21B 10/5673 175/428 |
| 5,871,060 | A * | 2/1999 | Jensen | E21B 10/5673 175/420.2 |
| 6,550,556 | B2 | 4/2003 | Midlemiss et al. | |
| 7,363,992 | B2 * | 4/2008 | Stowe | E21B 29/06 175/426 |
| 7,703,559 | B2 * | 4/2010 | Shen | E21B 10/5673 175/432 |
| 7,730,977 | B2 * | 6/2010 | Achilles | B23B 27/148 175/434 |
| 7,757,785 | B2 * | 7/2010 | Zhang | E21B 10/5673 175/430 |
| 7,798,257 | B2 | 9/2010 | Shen et al. | |
| 8,087,478 | B2 | 1/2012 | Patel | |
| 8,096,372 | B2 | 1/2012 | Shen et al. | |
| 8,113,303 | B2 | 2/2012 | Zhang et al. | |
| 8,191,656 | B2 | 6/2012 | Dourfaye et al. | |
| 8,919,462 | B2 | 12/2014 | Digiovanni et al. | |
| 9,103,174 | B2 | 8/2015 | Digiovanni et al. | |
| 9,376,867 | B2 | 6/2016 | Digiovanni et al. | |
| 10,287,825 | B2 * | 5/2019 | Chen | E21B 10/5735 |
| 10,400,517 | B2 * | 9/2019 | Borge | E21B 10/5673 |
| 2007/0235230 | A1 * | 10/2007 | Cuillier | E21B 10/573 175/428 |
| 2010/0084198 | A1 * | 4/2010 | Durairajan | E21B 10/55 175/430 |
| 2014/0182947 | A1 | 7/2014 | Bhatia et al. | |
| 2015/0047910 | A1 | 2/2015 | Chen et al. | |
| 2015/0047913 | A1 | 2/2015 | Durairajan et al. | |
| 2016/0130882 | A1 | 5/2016 | Digiovanni et al. | |
| 2017/0044836 | A1 | 2/2017 | Digiovanni et al. | |

* cited by examiner

CUTTING ELEMENTS HAVING NON-PLANAR SURFACES AND TOOLS INCORPORATING THE SAME

CROSS-REFERENCE TO RELATED APPLICATIONS

This application claims the benefit of, and priority to, U.S. Patent Application No. 62/554,128, filed Sep. 5, 2017, which application is expressly incorporated herein by this reference in its entirety.

BACKGROUND

Fixed cutter drill bits are widely used in the petroleum and mining industry for drilling wellbores through earth formations. Such bits include a bit body with a threaded connection at a first end for attaching to a drill string, and cutting structure formed at an opposite end for drilling through earth formation. The cutting structure includes blades that extend radially outwardly from a longitudinal axis of the bit body. Ultrahard compact cutters are mounted in pockets formed in the blades and affixed thereto by brazing. Fluid ports are also positioned in the bit body to distribute fluid around the cutting structure of the bit to cool the cutters and to flush formation cuttings away from the cutters and borehole bottom during drilling.

Cutters used for fixed cutter drill bits can include ultrahard compacts which include a layer of ultrahard material bonded to a substrate of less hard material through a high pressure/high temperature process. For example, cutters may be formed having a substrate or support stud made of carbide (e.g., tungsten carbide), and an ultrahard cutting surface layer or "table" made of a polycrystalline diamond or polycrystalline boron nitride material deposited onto or otherwise bonded to the substrate at an interface surface. Cutters are conventionally cylindrical in form with circular cross sections.

In mounting cutters on a bit, a trade off exists between the depth of cutter setting into the bit body and the remaining cutter exposure available for drilling. Cutters are typically mounted with about one-half of the cutter body exposed for drilling, with the other half being embedded within the blade. For drilling applications where cutters may become exposed to high impact loads, such as in drilling rock formations tough in shear or in high speed drilling applications, more than half of the cutter body surface may be embedded in the pocket within the blade to provide sufficient braze strength for retaining the cutters in place during drilling.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter According to some embodiments, a cutting element includes a body, a non-planar cutting face formed on a first end of the body, and an edge formed around a perimeter of the cutting face. The cutting face includes a central raised portion, and the edge has an edge angle defined between the cutting face and a side surface of the body. The edge angle varies around the perimeter of the cutting face and includes an acute edge angle defined by a portion of the cutting face extending downwardly from the edge to a depth from the cutting angle.

In accordance with one or more additional embodiments, a cutting element includes a body, a non-planar cutting face, and an edge extending around a perimeter of the non-planar cutting face. A height may be measured between a base surface of the body and the non-planar cutting face and is variable around the perimeter. A first portion of the edge extends higher than a second portion of the edge, and an edge angle defined between the non-planar cutting face and a side surface of the body is less than 90° in at least one section of the first portion of the edge and greater than 90° at the second portion of the edge.

In some embodiments, a cutting element includes a substrate and a cutting layer. The cutting layer is on the substrate and defines a cutting edge, a non-planar cutting face opposite the substrate, and an impact resistant feature at an interface between the cutting edge and the non-planar cutting face.

Another example cutting element includes a substrate, a cutting layer on the substrate at an interface, and a non-planar cutting face formed on the cutting layer opposite the interface. The non-planar cutting face includes at least three raised portions forming a generally sinusoidal cross-sectional profile when viewed along a cross-sectional plane intersecting an entire length of the cutting element.

In further examples, a drill bit includes a body and cutting structure that defines a cutting profile. Cutting elements as disclosed herein may be on the cutting profile.

Other aspects and advantages of embodiments of the present disclosure will be apparent from the following description and the appended claims.

BRIEF DESCRIPTION OF DRAWINGS

FIGS. 6-1 and 6-2 are cross-sectional views of the cutting element of FIG. 3 engaging a formation at different depths of cut.

FIGS. 7-1 to 7-3 are perspective, top, and cross-sectional view, respectively, of a cutting element according to embodiments of the present disclosure.

FIGS. 8-1 to 8-3 are perspective and various cross-sectional views, respectively, of a cutting element according to embodiments of the present disclosure.

FIGS. 9-1 and 9-2 are cross-sectional and perspective views, respectively, of a cutting element according to embodiments of the present disclosure.

FIGS. 10-1 and 10-2 are side and top views, respectively, of a cutting element according to embodiments of the present disclosure.

FIGS. 10-3 to 10-9 are various cross-sectional views of the cutting element of FIGS. 10-1 and 10-2.

FIGS. 11-1 to 11-6 are views of a cutting element according to additional embodiments of the present disclosure.

FIGS. 12-1 to 12-3 are views of another cutting element according to embodiments of the present disclosure.

FIGS. 17-1 and 17-2 are cross-sectional views of a cutting element at different orientations within a cutter pocket according to embodiments of the present disclosure.

DETAILED DESCRIPTION

Cutting elements according to the present disclosure may include cutting elements having a non-planar cutting face that includes a geometry with an edge angle formed around a portion of the edge of the cutting face, where an edge angle refers to the angle measured between the cutting face and the side surface of the cutting element along the edge. As described herein, a non-planar cutting face may include one or more cutting edge portions having an acute or 90° edge angle and one or more edge portions having an edge angle greater than or equal to 90°. For example, an edge formed around a perimeter of a non-planar cutting face may include an alternating pattern of acute and/or right edge angle portions spaced apart by obtuse and/or right edge angle portions.

Non-planar cutting faces according to embodiments of the present disclosure may be symmetric about a plane extending longitudinally through the cutting element. For example, as described in some of the embodiments disclosed herein, a non-planar cutting face may have a generally sinusoidal cross-sectional profile that is symmetric along a plane perpendicular to the cross-sectional profile. In some embodiments, a non-planar cutting face may have one or more plane of symmetry, including but not limited to, two planes of symmetry where the two planes are perpendicular to each other, or three planes of symmetry. Further, non-planar cutting faces according to embodiments of the present disclosure may include multiple edge angle portions formed around the edge of the cutting face (e.g., a single acute/right edge angle portion forming less than the entire edge of the cutting face and the remaining portion(s) of the edge having right/obtuse edge angle portions, or multiple spaced apart acute/right edge angle portions), such that asymmetry is formed around a central longitudinal axis of the cutting element.

Figure 1:
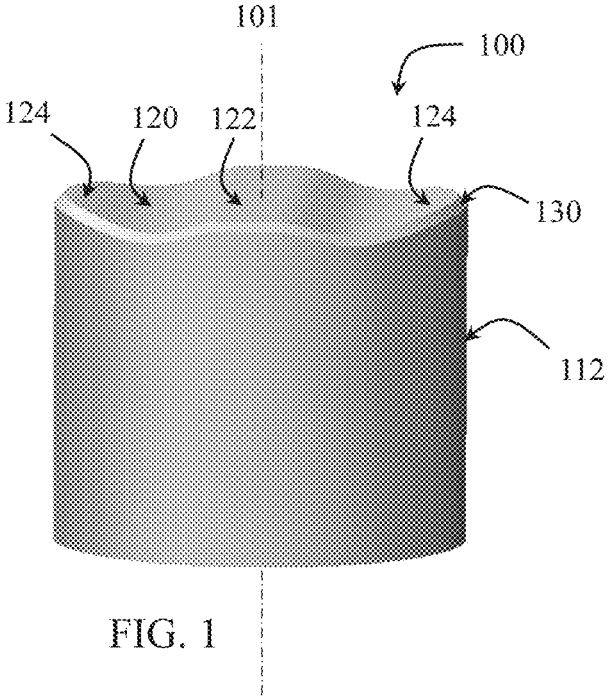
FIG. 1 is a perspective view of a cutting element according to embodiments of the present disclosure.
Figure 2:
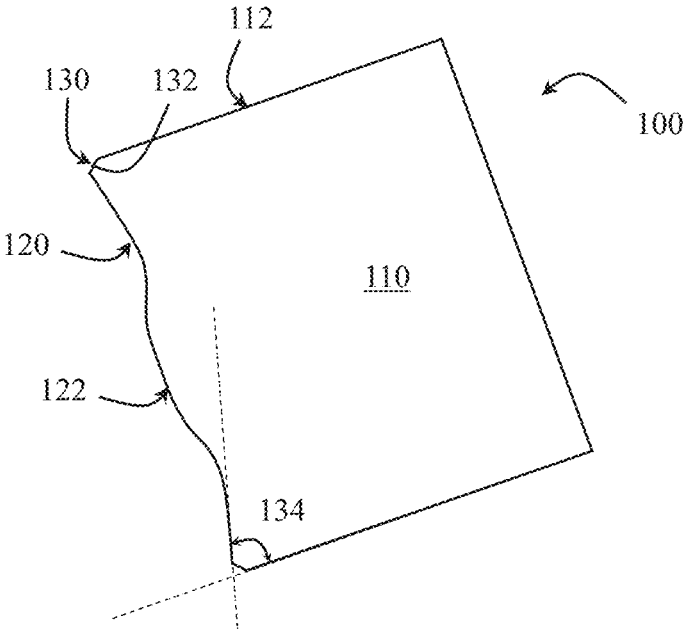
FIG. 2 is a cross-sectional view of a cutting element according to embodiments of the present disclosure.

FIGS. 1 and 2 are perspective and cross-sectional views, respectively, of an example of a cutting element according to embodiments of the present disclosure. The cross-sectional view shown in FIG. 2 is taken at a plane extending along and intersecting a longitudinal axis 101 of the cutting element 100. The cutting element 100 includes a body 110 and a cutting face 120 formed at a first end portion of the body 110. The cutting face 120 in FIGS. 1 and 2 has a wavy, undulating geometry, having a central raised region 122 and two outer raised regions 124 spaced apart from and on opposite sides of the cutting face 120. The undulating surface geometry of the cutting face 120 is symmetric about the plane of the cross-sectional view in FIG. 2, as well as symmetric about a plane perpendicular to the cross-sectional plane, where both planes of symmetry extend along and intersect with the longitudinal axis 101.

In the illustrated embodiment, the cutting face 120 has two-fold rotational symmetry (discrete rotational symmetry of the second order) about the longitudinal axis 101, where the geometric configuration of the cutting element is the same when the cutting face is rotated 180° around the longitudinal axis. In some embodiments, a cutting face may be asymmetric, having one-fold rotational symmetry (where the geometric configuration of the cutting element remains the same after a complete 360° rotation about the longitudinal axis), for example, when the cutting face surface geometry includes a single outer raised region formed along less than the entire perimeter of the cutting face. In some embodiments, a cutting face may have three-fold rotational symmetry (where the geometric configuration of the cutting element is the same when the cutting face is rotated 120° around the longitudinal axis), for example, when the cutting face surface geometry includes three outer raised regions formed along the perimeter of the cutting face. In some embodiments, a cutting face may have four-fold (or more) rotational symmetry.

An edge 130 is formed around a perimeter of the cutting face 120 at the junction between the cutting face 120 and a side surface 112 of the cutting element 100. In some embodiments, such as shown in FIGS. 1 and 2, the edge 130 may include a chamfer or bevel 132 formed at the junction between the cutting face 120 and the side surface 112, while in other embodiments, at least part of an edge may be formed at the junction of the cutting face and side surface without a bevel.

The shape of an edge 130 may be described according to its cross-sectional profile along a plane intersecting the edge and perpendicular to the side surface at the edge. For example, a profile of an edge may include a curved transition between the cutting face and side surface portions at the edge, a bevel formed at the junction between the cutting face and side surface portions at the edge, or an angled transition between the cutting face and side surface portions at the edge. Further, an edge may have an edge angle defined between the cutting face and the side surface of the cutting element. For example, as shown in FIG. 2, a line tangent to the cutting face 120 at edge 130 and a line tangent to the side surface 112 at edge 130 intersect to define an edge angle 134. The edge angle 134 varies around the perimeter of the cutting face 120 in the illustrated embodiment. For example, the portions of the edge 130 shown in the cross-sectional profile of FIG. 2 have an acute edge angle 134. Other portions of the edge 130 may have right or obtuse edge angles, such as shown along the portions of the edge 130 bordering or proximate a central raised region 122 in the cutting face 120 in FIG. 1.

Depending on the orientation of the cutting element in a cutting tool and the relative orientation between the tool and the formation being engaged by the tool, certain portions of the edge may act as a cutting edge, which contacts and engages the formation. In some embodiments, cutting elements may be in a cutter pocket formed on a cutting tool such that an acute edge angle portion of the edge forms the cutting edge of the cutting element. In some embodiments, cutting elements may be oriented in a cutter pocket formed on a cutting tool such that a right or obtuse edge angle portion of the edge forms the cutting edge of the cutting element. Further, in some embodiments, a cutting element having a non-planar surface geometry, such as disclosed herein, may be rotated within a cutter pocket to alter the edge angle portion acting as the cutting edge, thereby altering the effective back rake angle (or engagement angle). In some embodiments, a cutting element having a first surface geometry (e.g., a planar or non-planar surface geometry) may be replaced with a cutting element having a non-planar surface geometry described herein to alter the edge angle acting as the cutting edge, thereby altering the engagement angle of the cutting element.

As used herein, an engagement angle refers to the angle measured between a line tangent to the portion of the cutting face to engage a formation and a line perpendicular to the formation being engaged (or working surface). The portion of a cutting face that engages a formation may depend on, for example, the distance the cutting element protrudes (extension height) from an outermost surface of the cutting tool on which the cutting element is disposed and the depth of cut of the cutting element. With cutting elements having a non-planar cutting face geometry at the cutting edge, such as disclosed herein, the engagement angle measured along the engagement area of the non-planar cutting face may vary along the depth of cut.

Figure 3:
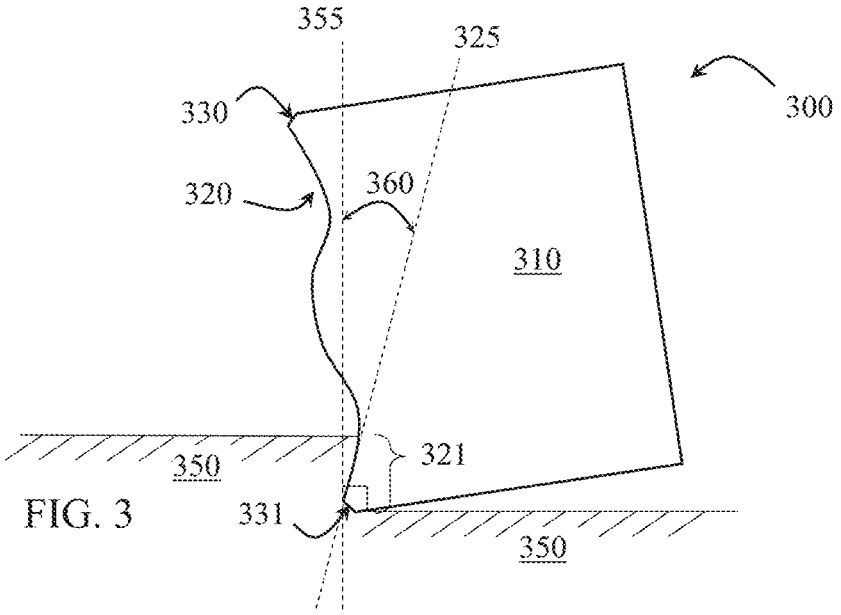
FIG. 3 is a cross-sectional view of a cutting element according to embodiments of the present disclosure.
Figure 4:
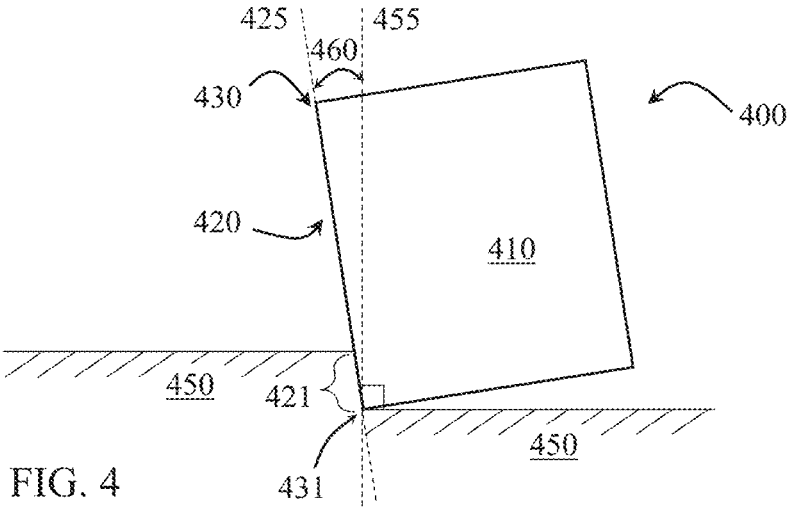
FIG. 4 is a cross-sectional view of a cutting element according to embodiments of the present disclosure.
Figure 5:
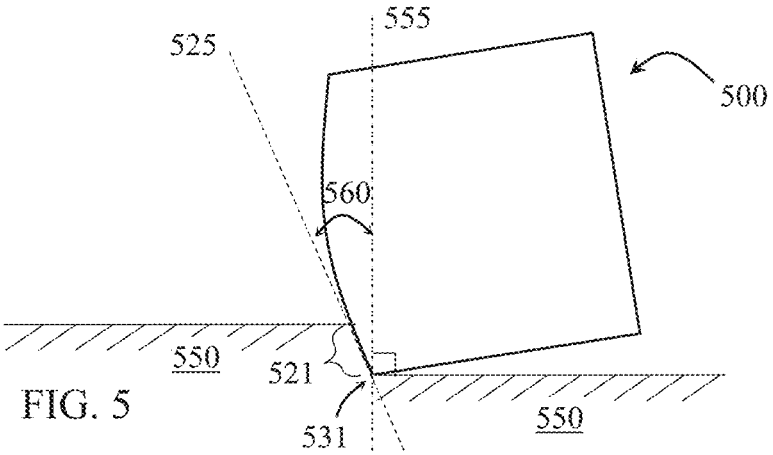
FIG. 5 is a cross-sectional view of a cutting element according to embodiments of the present disclosure.

FIGS. 3-5 show examples of three different cutting profiles of a cutting element positioned at a given orientation. As shown, although each cutting element is oriented in the same position, the different surface geometry along the engagement area of the cutting face provides different engagement angles with respect to a formation being engaged.

FIG. 3 is a cross-sectional view of a cutting element 300 having a non-planar cutting face 320 formed at a first end of a body 310. The cutting element 300 may be in a cutter pocket (not shown) and have an acute edge angle portion of the edge 330 that forms the cutting edge 331 of the cutting element. As the cutting element is engaged with and moved across a formation 350, an engagement area 321 of the cutting face 320 extends the depth of cut into the formation 350. An engagement angle 360 is defined between the line 355 perpendicular to the formation 350 being cut and the line 325 tangent to the engagement area 321 of the cutting face 320. In the embodiment shown, the engagement area 321 of the cutting face 320 has a concave cross-sectional profile, and thus, the engagement angle 360 varies along the depth of cut. In some embodiments, a cross-sectional profile of an engagement area of a non-planar cutting face may have a planar region, where the engagement angle is constant along the depth of cut for the planar region. However, in some embodiments, the engagement area has both planar and non-planar regions or may be entirely non-planar, where the engagement angle may vary along the depth of cut engaging the varying regions of the engagement area.

According to embodiments of the present disclosure, an engagement angle 360 formed at an acute edge angle portion of a cutting element may be positive, for example, within a range having a lower limit, an upper limit, or both lower and upper limits including any of 00, 2°, 5°, 10°, 15°, 20°, 25°, 30°, 40°, 50°, or any values therebetween, where any relatively lower value may be selected in combination with any relatively higher value. If engagement angles disclosed herein were to be considered in terms of back rake angles for conventional cutting angles, positive back rake angles may not be achievable at the values described herein.

Further, in some embodiments of the present disclosure, an engagement angle 360 varying along a depth of cut may have a difference in value of greater than 2°, for example, up to 5°, up to 10°, or more. For example, an engagement angle formed along an engagement area having a concave cross-sectional profile may have a difference in engagement angles along the depth of cut of ranging from about 5° to about 15°, or more, depending on the radius of curvature of the concave cross-sectional profiles.

FIG. 4 is a cross-sectional view of a cutting element 400 in a cutter pocket at the same orientation (i.e., same angle between the longitudinal axis of the cutting element and the line perpendicular to the formation) as the cutting element 300 of FIG. 3, where the cutting element 400 is positioned in the cutter pocket to have a right edge angle portion of the edge 430 form the cutting edge 431 of the cutting element. As the cutting element is engaged with and moved across a formation 450, an engagement area 421 of the cutting face 420 extends the depth of cut into the formation 450. An engagement angle 460 is defined between the line 455 perpendicular to the formation 450 being cut and the line 425 tangent to the engagement area 421 of the cutting face 420. In the embodiment shown, the cutting element 400 may have a non-planar cutting face 420 formed at a first end of the body 410, where the non-planar cutting face includes a linear ridge extending between opposite sides of the edge 430, and where the cross section is taken along the linear ridge. The linear ridge may have a planar cross-sectional profile forming the right edge angle. In some embodiments, other cutting face geometries may form a right edge angle, for example a planar cutting face.

According to embodiments of the present disclosure, an engagement angle formed at a right edge angle portion of a cutting element may be negative, for example, having a lower limit, an upper limit, or both lower and upper limits including any of 0°, −2°, −5°, −10°, −15°, −20°, −25°, −30°, or any values therebetween, where any relatively lower value may be selected in combination with any relatively higher value. The engagement angle may be constant along the planar cross-sectional profile of the engagement area 421.

FIG. 5 is a cross-sectional view of a cutting element 500 in a cutter pocket at the same orientation as the cutting elements 300, 400 of FIGS. 3 and 4, where the cutting element 500 is positioned in the cutter pocket to have an obtuse edge angle portion of the edge 530 form the cutting edge 531 of the cutting element. The obtuse edge angle portion of the edge 530 may be formed by a convex ridge extending between opposite sides of the edge 530, where the convex ridge has a convex profile extending outwardly from a base surface of the cutting element 500. In some embodiments, other cutting face geometries may form an obtuse edge angle, for example, a planar surface extending upwardly and radially inward from the edge. As the cutting element is engaged with and moved across a formation 550, an engagement area 521 of the cutting face 520 extends the depth of cut into the formation 550. An engagement angle 560 is defined between the line 555 perpendicular to the formation 550 being cut and the line 525 tangent to the engagement area 521 of the cutting face 520.

According to embodiments of the present disclosure, an engagement angle formed at an obtuse edge angle portion of a cutting element may be negative, for example, within a range having a lower limit, an upper limit, or lower and upper limits including any of −5°, −10°, −15°, −25°, −30°, −40°, −50°, or any value therebetween, where any relatively lower value may be selected in combination with any relatively higher value. The engagement angle may vary along the convex cross-sectional profile of the engagement area 521. In some embodiments, an engagement angle varying along a depth of cut may have a difference in value of greater than 2°, for example, up to 5°, up to 10°, or more. For example, an engagement angle formed along an engagement area having a convex cross-sectional profile may have a difference in engagement angles along the depth of cut of ranging from about 5° to about 15°, or more, depending on the radius of curvature of the convex cross-sectional profile. In embodiments having an obtuse edge angle with a planar surface forming the engagement area cross-sectional profile, the engagement angle may be constant or varied along the depth of cut.

FIGS. 3-5 show how cutting elements having non-planar cutting faces according to embodiments of the present disclosure may be rotated and positioned within a cutter pocket at a given orientation to vary the engagement angle of the cutting element. Similarly, cutting elements having a first type of cutting face surface geometry (e.g., a planar cutting face or a non-planar cutting face) may be replaced with cutting elements having a non-planar cutting face according to embodiments of the present disclosure to alter the engagement angle.

Figures 1, 6:
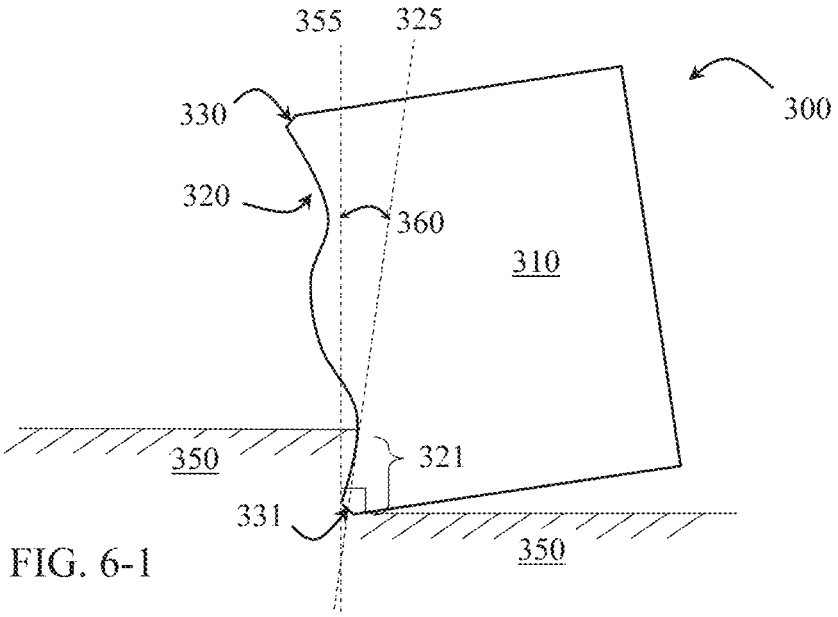
Figures 2, 6:
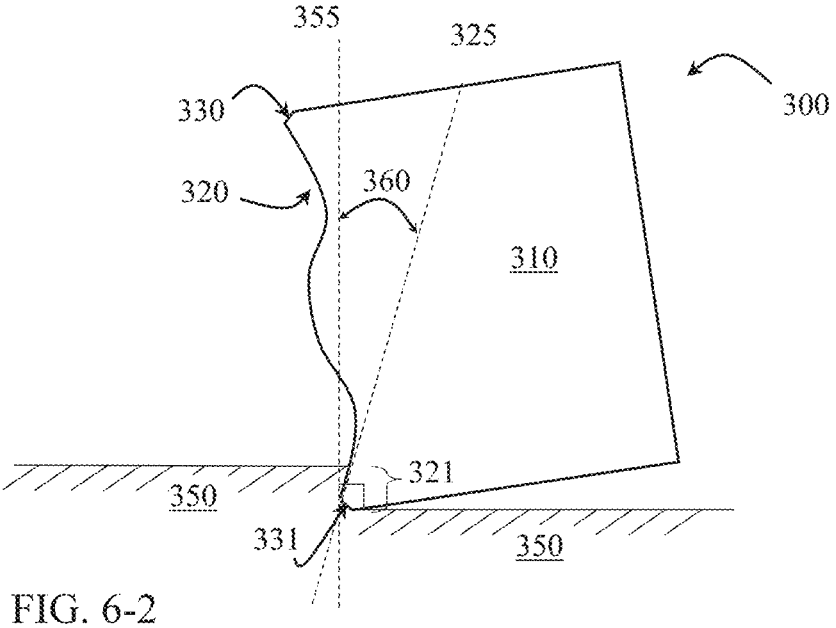

Further, an engagement angle formed by a non-planar cutting face according to embodiments of the present disclosure may vary depending on the depth of cut. For example, FIGS. 6-1 and 6-2 show the cutting element shown in FIG. 3 cutting at different depths of cut. Due to the curved profile of the cutting face region contacting the formation 350 being cut, the engagement angle 360 at the surface of the formation in the relatively deeper depth of cut shown in FIG. 6-1 is relatively smaller than the engagement angle 360 at the surface of the formation in the relatively shallower depth of cut shown in FIG. 6-2.

Non-planar cutting faces according to embodiments of the present disclosure may include an undulating surface geometry, where relatively raised portions form two opposite sides of the edge of a cutting element. In some embodiments, at least one raised portion may be formed between the outer raised portions at the edge and spaced apart by relatively depressed portions. For example, a single central raised portion in the shape of a ridge may be spaced between outer raised portions at a cutting element edge, or more than one ridge may be spaced between outer raised portions of a cutting element edge, where each raised portion may be spaced apart from each other by a relatively depressed portion. In some embodiments, a single central raised portion may be dome shaped, i.e., the central raised portion does not extend across the entire diameter of the cutting element but may be spaced a distance from the entire periphery. It is envisioned that the single central raised portion may be axisymmetric or not. In some embodiments, the single central raised portion may extend across a full width or diameter of the cutter, although in other embodiments a single central raised portion may extend along a partial width or diameter of the cutter. In embodiments in which a raised portion extends across a partial width or diameter of the cutter, the raised portion may extend from an outer edge toward a center or axis of the cutting face, or may extend from the center of the cutting face radially outward in a single or in each of opposing directions toward an outer edge.

Figures 1, 7:
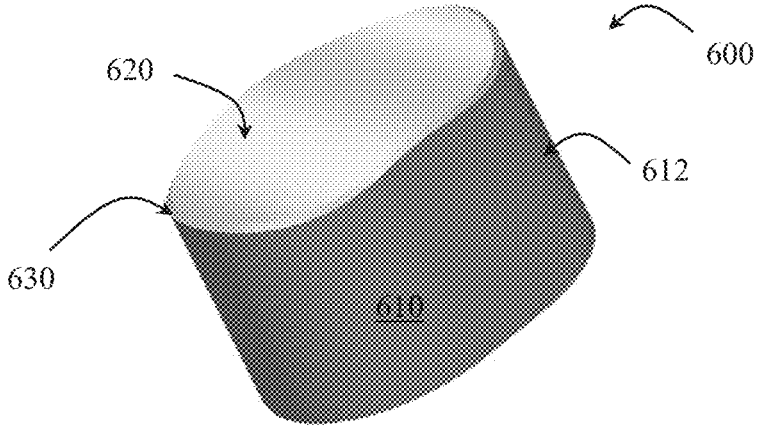
Figures 2, 7:
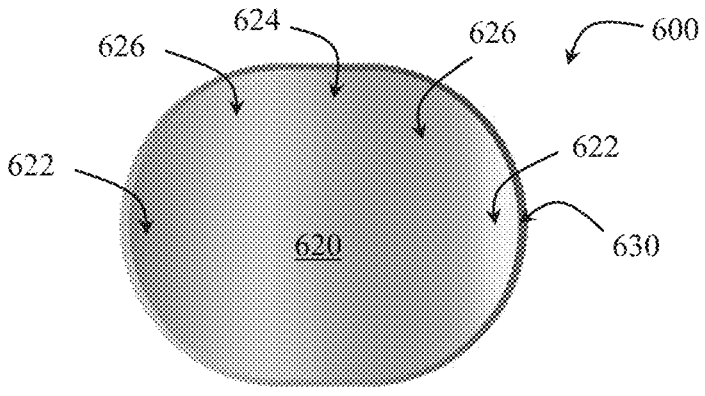
Figures 3, 7:
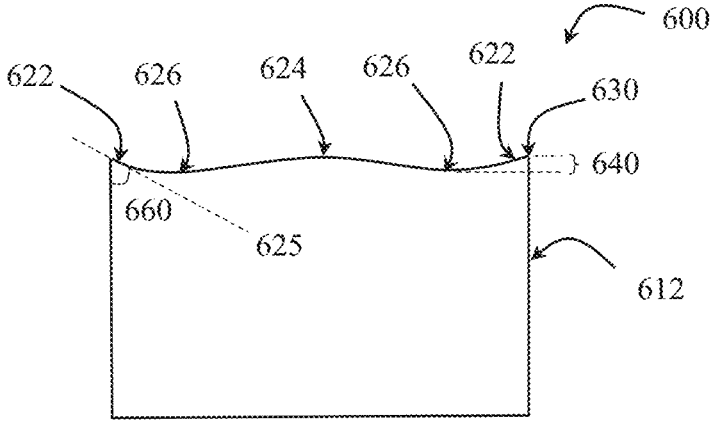

FIGS. 7-1 to 7-3 are perspective, top, and cross-sectional views, respectively, of a cutting element 600 having a non-planar cutting face 620 according to embodiments of the present disclosure. The non-planar cutting face 620 has an undulating surface geometry, where relatively raised portions 622 form two opposite sides of the edge 630 of the cutting element, and a central raised portion 624 is formed between and spaced apart from the outer raised portions 622 by relatively depressed portions 626. The central raised region 624 of the non-planar cutting face 620 forms a ridge extending between opposite sides of the perimeter of the cutting face 620 and through a central region of the cutting face 620.

Non-planar cutting face geometries according to embodiments of the present disclosure may be formed on an elliptical cylinder shaped body 610, such as shown in FIGS. 7-1 to 7-3, or on bodies having other geometries, such as cylindrically shaped bodies (e.g., as shown in FIGS. 1 and 2) or a rounded rectangular prism shaped body. As shown, a cutting element body 610 includes a side surface 612 that joins the cutting face 620 at edge 630. The edge 630 has an acute edge angle 660 portion formed at the outer raised portions 622 between a line 625 tangent to the cutting face at the acute edge angle portion and the line tangent to the side surface 612. The acute edge angle 660 be in a range, for example, that is greater than 35°, greater than 45°, or greater than 60° and up to 89°.

According to embodiments of the present disclosure, a portion of a cutting element edge may have an acute edge angle defined by a portion of the cutting face extending downwardly from the edge toward a central region of the cutting face to a depth from the cutting edge. For example, as shown in the cross-sectional view of FIG. 7-3, an acute edge angle portion formed at the edge 630 may be defined by a raised portion 622 of the cutting face extending downwardly from the edge 630 toward a central region of the cutting face to depth 640. The depth 640 may range, for example, from about 0.5 cm to about 2 cm. In some embodiments, a depth of an acute edge angle portion may be less than 2%, less than 5%, or less than 10% of the total depth of the cutting element.

Further, cutting elements of the present disclosure may include a cutting layer on a substrate at an interface, where the cutting face is formed on the cutting layer opposite the interface. A portion of a cutting face forming an acute edge angle portion may extend downwardly from the edge toward a central region of the cutting face to a depth ranging from less than about 5%, less than 25%, less than 50%, less than 75%, at least 5%, at least 10%, at least 50%, at least 75%, or between 5% and 75% of a total thickness of the cutting layer.

Figures 1, 8:
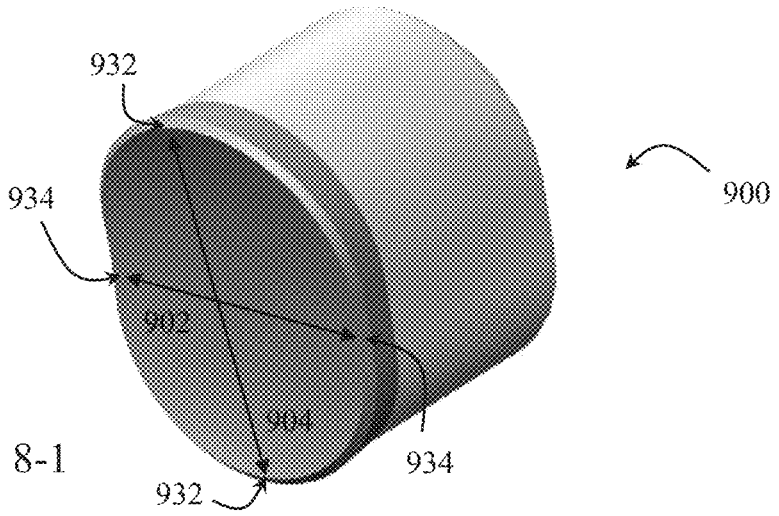
Figures 2, 8:
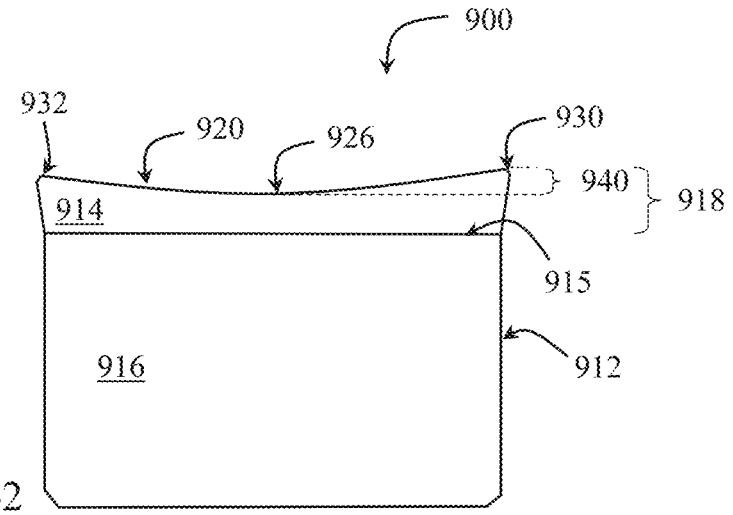
Figures 3, 8:
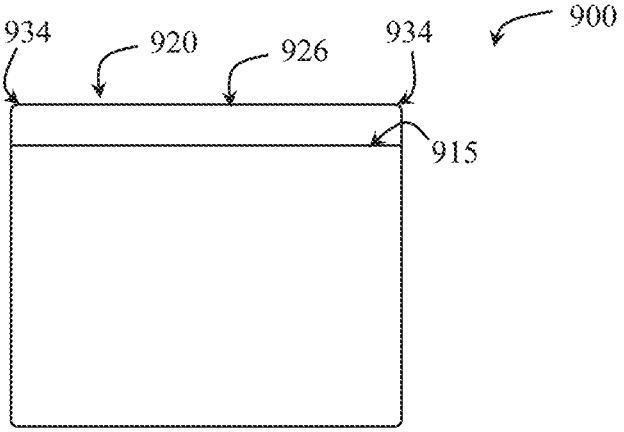

For example, FIGS. 8-1 to 8-3 show a cutting element 900 according to embodiments of the present disclosure that includes a body having a cutting layer 914 on a substrate 916 at an interface 915. A cutting face 920 is formed on the cutting layer 914 opposite the interface 915. An edge 930 is formed at the junction of the cutting face 920 and a side surface 912, where the edge 930 extends around a perimeter of the cutting face 920. The edge 930 has different heights (e.g., relative to the interface 915 or a base of the substrate 916), wherein at least one high portion 932 of the edge has an acute edge angle formed between a portion of the cutting face 920 and the side surface 912 of the cutting element 900 along the high portion 932 of the edge 930. The acute edge angle portion (forming the high portion 932) is formed by a portion of the cutting face 920 extending downwardly from the edge 930 toward a lower point or lower region of the cutting face 920 at depth 940. The depth 940 may be less than 50% of a total thickness 918 of the cutting layer 914 in some embodiments.

The edge 930 further includes a low portion 934, wherein the low portion 934 of the edge is a right edge angle portion having a right angle formed between a planar portion of the cutting face 920 (having a planar cross-sectional profile) and the side surface 912 of the cutting layer 914 along the right edge angle portion of the edge. In some embodiments, a low portion of an edge may be an obtuse edge angle portion having an obtuse angle formed between a convex portion of the cutting face and the side surface of the cutting element along the low portion of the edge. In yet other embodiments, a low portion of an edge may also be an acute edge angle portion having an acute angle formed between a concave portion of the cutting face and the side surface of the cutting element along the low portion of the edge. In such embodiments, the high portion(s) of the edge may be formed of portions of the cutting face having a relatively smaller radius of curvature (or steeper sloping planar surfaces) extending from the high portion(s) of the edge toward a central region of the cutting face when compared with the portions of the cutting face forming the low portion(s) of the edge.

Referring still to FIGS. 8-1 to 8-3, two low portions 934 are at the outer ends of a linear depressed region 926, where the linear depressed region 926 spaces apart two outer raised portions forming the high portions 932 of the edge 930. The linear depressed region 926 extends across a minor diameter 902 of the cutting face 920 and has a planar cross-sectional profile along a cross-section taken through the minor diameter 902, where the planar portion of the cutting face 920 forms the right edge angle portion (see cross-section of FIG. 8-3). The cross-sectional profile of the cutting face 920 taken through the major diameter 904 (see cross-section shown in FIG. 8-2) has a concave profile, where the cutting face 920 extends downwardly from the high portions 932 toward a central region (the linear depressed region 926) of the cutting face to depth 940. The concave profile may have a radius of curvature, which may range, for example, up to two times the major diameter 904, up to four times the major diameter 904, up to six times the major diameter 904, or up to eight times the major diameter 904. In other embodiments, the concave profile may include linear segments that form a piecewise continuous profile.

An edge of a cutting element according to embodiments of the present disclosure may have a bevel formed around the entire edge (such as the bevel shown in edge 930 in FIGS. 8-1 to 8-3), or a bevel/chamfer may be formed around less than the entire edge, such as along high portions of the edge. In some embodiments, a curved transition surface may be formed at the junction of the cutting face and the side surface of a cutting element. A transition surface, such as a bevel, chamfer, or a curved transition surface, may have a relatively small size compared with the size of the cutting element, and thus may be negligible or close to negligible when measuring the diameter of the cutting face and the height of the side surface of a cutting element. For example, a bevel or a curved transition surface may have a height of less than 2%, or in some embodiments, less than 5% of the total height of the cutting element and may have a radial distance of less than 1%, or in some embodiments, less than 3%.

In the embodiment shown in FIGS. 8-1 to 8-3, the interface 915 is planar, where the thickness of the cutting layer 914 is greatest at the high portions 932 of the edge 930 and smallest along the depressed region 926 and low portions 934 of the edge 930. In some embodiments, an interface between a substrate and a cutting layer may be non-planar. For example, an interface may have a non-planar geometry corresponding in shape and orientation to a non-planar cutting face of the cutting element. In such embodiments, the thickness of the cutting layer may be uniform along the entire cutting layer. In some embodiments, an interface may have a non-planar geometry that does not correspond in shape and/or orientation to a non-planar cutting face.

According to embodiments of the present disclosure, a cutting element may include a sloped side surface extending radially outward in a direction from a base surface of the cutting element toward the cutting face of the cutting element. The entire side surface or less than the entire side surface of a cutting element may be sloped outwardly in a direction from the base surface toward the cutting face of the cutting element. For example, as shown in FIGS. 8-1 to 8-3, a portion of the side surface 912 around the cutting layer 914 may be sloped, while the entire side surface 912 around the substrate 916 may be parallel with a longitudinal axis of the cutting element 900. The sloped portion of the side surface 912 around the cutting layer 914 extends radially outward in a direction from the interface 915 to the high portions 932 of the edge 930. The remaining portions of the side surface 912 extend parallel with a longitudinal axis of the cutting element, from the interface 915 to the base surface of the cutting element and from the low portions 934 of the edge 930 to the base surface of the cutting element.

In some embodiments, the side surface of a substrate of a cutting element may extend substantially parallel with a longitudinal axis of the cutting element, and the side surface around the entire perimeter of the cutting layer of the cutting element may extend in a radially outward direction from the interface to the edge. In some embodiments, the entire side surface of a cutting element may extend radially outward from the base surface of the cutting element to the cutting face of the cutting element. In some embodiments, the side surface around one or more portions of the cutting element perimeter may have an outwardly sloping profile from the base surface to the cutting face, while one or more other portions of the side surface may extend substantially parallel to the longitudinal axis from the base surface to the cutting face.

Figures 1, 9:
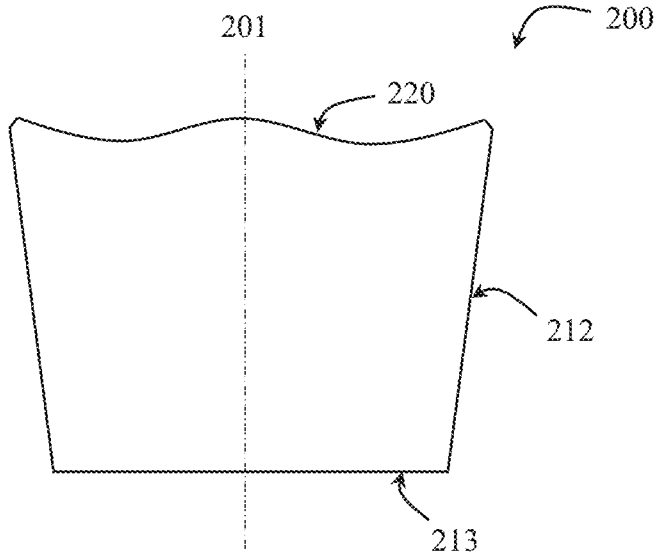
Figures 2, 9:
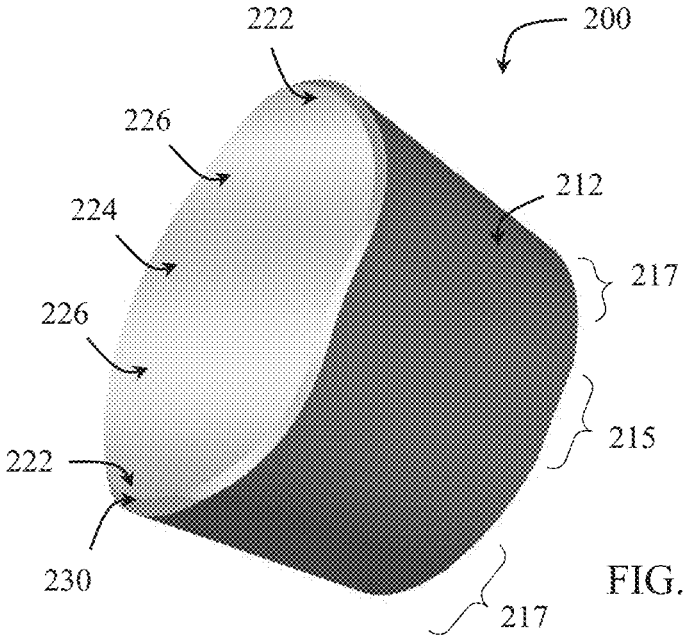

For example, FIGS. 9-1 and 9-2 are views of an example cutting element 200 having a portion of the side surface 212 sloping outwardly from a base surface 213 to a cutting face edge 230 of the cutting element 200. The cutting element 200 has a non-planar cutting face 220 according to embodiments of the present disclosure, where the side surface 212 includes portions 217 that are outwardly sloping in a direction from the base surface 213 to the cutting face 220, and portions 215 that are parallel with a central longitudinal axis 201 of the cutting element 200. The cross-sectional profile of the cutting face 220 has a sinusoidal shape, wherein the cross-sectional profile is at a plane extending along and intersecting with the central longitudinal axis 201. Two outer raised portions 222 and a central raised portion 224 spaced apart by depressed regions 226 form the sinusoidal cross-sectional profile.

The two outer raised portions 222 and the central raised portion 224 extend the same height and form the highest portions around an edge 230. However, in other embodiments, raised portions forming a non-planar cutting face may extend different heights. The outer raised portions 222 form a first high portion and a second high portion of the edge 230, and the central raised portion 224 extends linearly across the cutting face from a third high portion of the edge 230 to a fourth high portion of the edge 230. Outwardly sloping portions 217 of the side surface 212 extend between the base surface 213 to the first and second high portions formed along the outer raised portions 222, and portions 215 of the side surface 212 parallel to the longitudinal axis extend between the base surface 213 to the third and fourth high portions of the edge 230.

According to embodiments of the present disclosure, a cutting element may include a body, a non-planar cutting face, a height measured between a base surface of the body and the non-planar cutting face, and an edge extending around a perimeter of the non-planar cutting face, where the height of the edge varies around the perimeter. A first portion of the edge may extend higher than a second portion of the edge, and an edge angle defined between the non-planar cutting face and a side surface of the body at the first portion of the edge may be less than 90°. In some embodiments, the first portion of the non-planar cutting face forming the first portion of the edge may have a curved region, such that the curved region of the non-planar cutting face may have a concave profile at the first portion of the edge to form the edge angle of less than 90° (an acute edge angle). In some embodiments, the first portion of the non-planar cutting face forming the first portion of the edge may have a downwardly sloping planar region to a depth from the edge, such that the planar region of the non-planar cutting face may have a planar profile at the first portion of the edge to form the edge angle of less than 90°.

The edge angle at the second portion of the edge may be greater than or equal to 90°. For example, in some embodiments, a second portion of the non-planar cutting face forming the second portion of the edge may have a curved region, such that the curved region of the non-planar cutting face may have a convex profile at the first portion of the edge to form an edge angle of greater than 90° (an obtuse edge angle). Non-planar cutting faces according to embodiments of the present disclosure may have a symmetric geometry relative to a plane extending through the second portion of the edge and a central longitudinal axis of the cutting element.

Figures 1, 10:
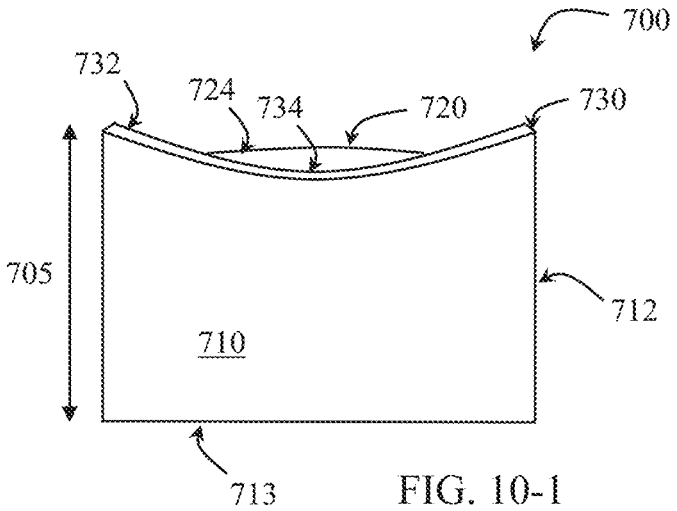
Figures 2, 10:
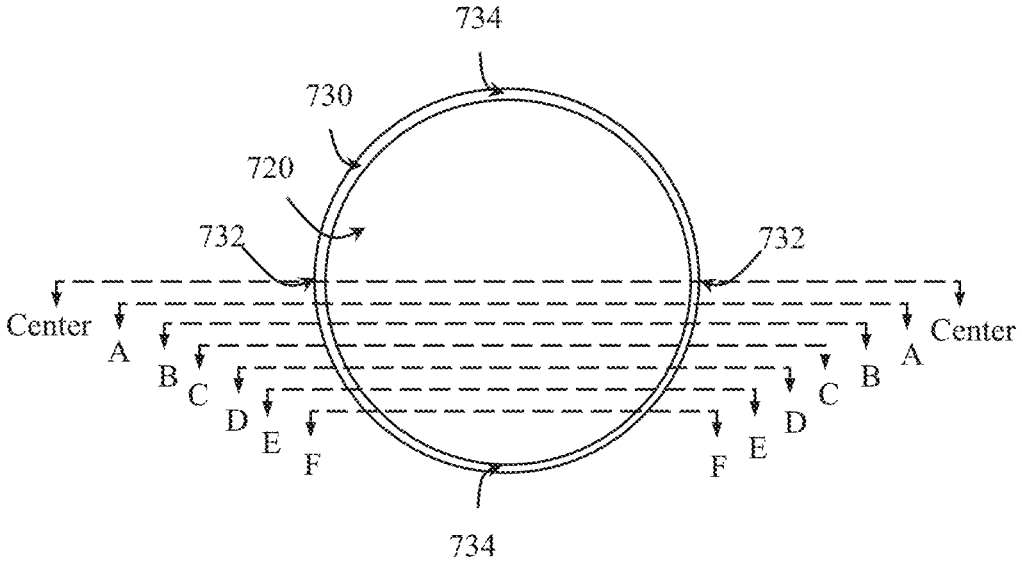
Figures 3, 10:
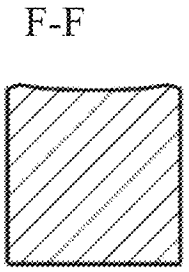
Figures 4, 10:
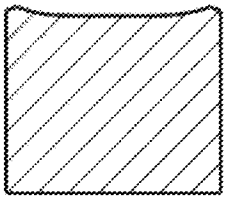
Figures 5, 10:
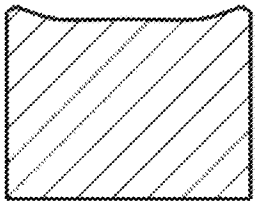
Figures 6, 10:
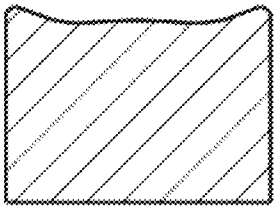
Figures 7, 10:
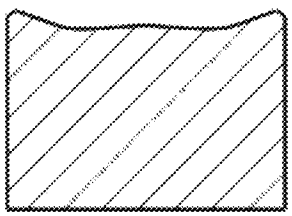
Figures 8, 10:
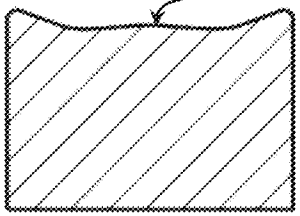
Figures 9, 10:
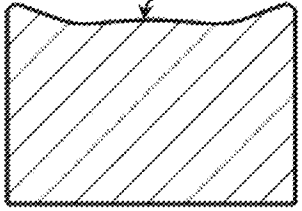

FIGS. 10-1 to 10-9 show an example of a cutting element according to embodiments of the present disclosure. FIG. 10-1 is a side view of the cutting element 700, and FIG. 10-2 is a top view of the cutting element 700. FIGS. 10-3 to 10-9 are cross-sectional views of the cutting element 700 taken along cross sections F-F, E-E, D-D, C-C, B-B, A-A, and Center-Center shown in FIG. 10-2. The cutting element 700 has a body 710, a non-planar cutting face 720, a height 705 measured between a base surface 713 of the body and the non-planar cutting face 720, and an edge 730 extending around a perimeter of the non-planar cutting face 720. The height 705 of the edge varies around the perimeter, where a first portion 732 of the edge 730 may extend higher than a second portion 734 of the edge 730. An edge angle defined between the non-planar cutting face 720 and a side surface 712 of the body 710 at the first portion 732 of the edge may be less than 90°, and the edge angle at the second portion 734 of the edge may be greater than or equal to 90°.

A convex raised portion 724 of the cutting face 720 may be formed at a central region of the cutting face 720, spaced between the two first portions 732 of the edge having edge angles less than 90° and spaced between the two second portions 734 of the edge having edge angles of about 90°. The convex raised portion 724 extends a height less than the first portions 732 of the edge 730. Further, the second portions 734 of the edge also extend a height less than the first portions 732. In some embodiments, the second portion 734 may also extend a height less than the convex raised portion 724, but it may be greater than convex raised portions 724 in other embodiments.

According to embodiments of the present disclosure, a cutting element may include a body, a non-planar cutting face, a height measured between a base surface of the body and the non-planar cutting face, and an edge extending around a perimeter of the non-planar cutting face, where the height of the edge varies around the perimeter. The edge may include two or more high portions having an acute edge angle formed between the non-planar cutting face and a side surface of the body, where the high portions are spaced apart around the edge.

Figures 1, 11:
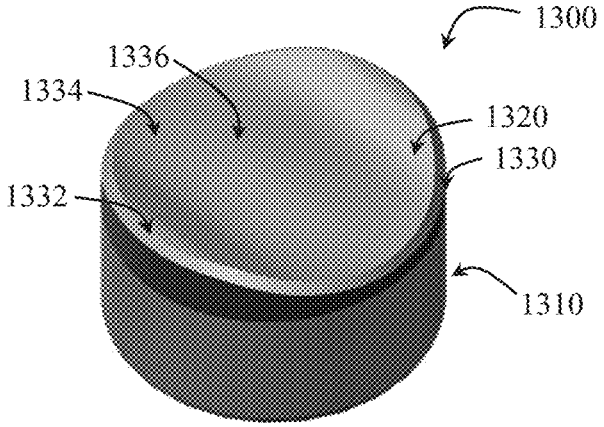
Figures 2, 11:
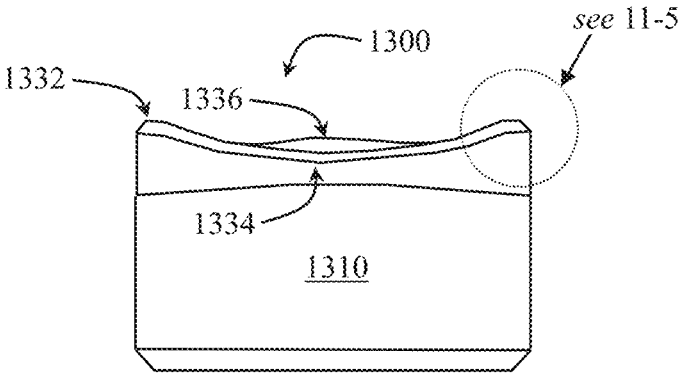
Figures 5, 11:
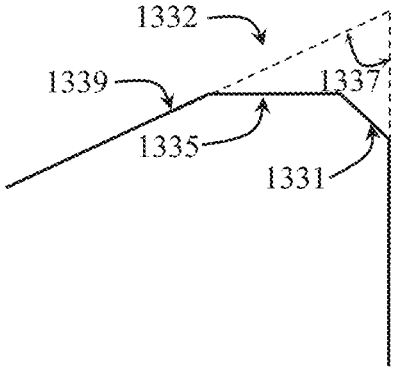
Figures 3, 11:
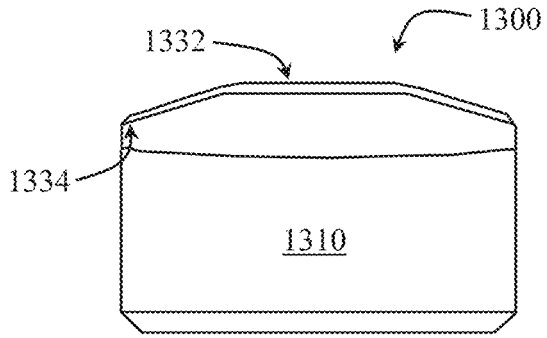
Figures 4, 11:
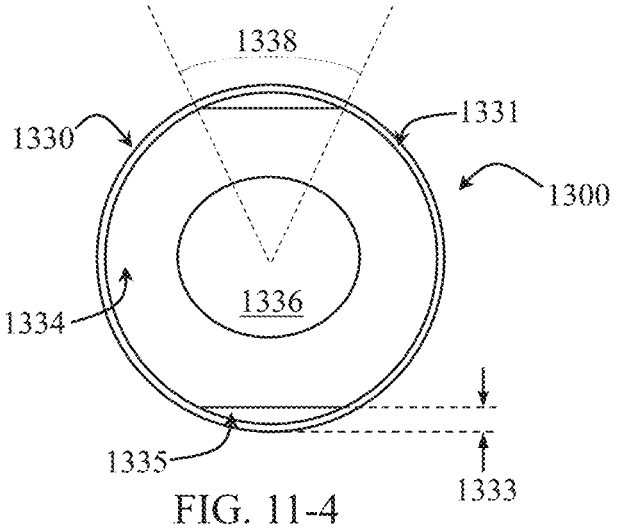
Figures 6, 11:
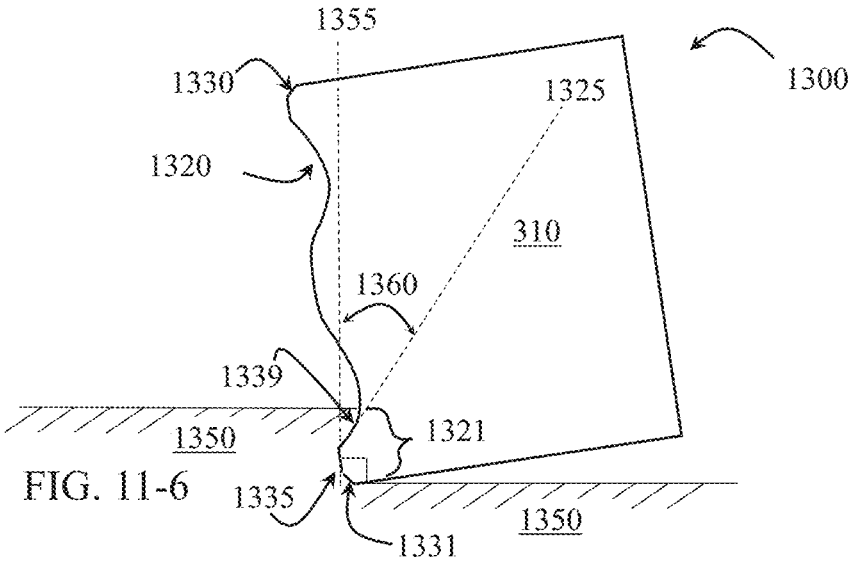

In some embodiments, a high portion at an end of a cutting element may include a planar, flat, or right surface adjacent an acute edge angle portion. FIGS. 11-1 to 11-5, for instance, illustrate various views of a cutting element 1300 in accordance with some embodiments of the present disclosure. FIG. 11-1 is a perspective view of the cutting element 1300, and FIGS. 11-2 and 11-3 are side views of the cutting element 1300. FIG. 11-4 is a top view of the cutting element 1300, and FIG. 11-5 is an enlarged view of a raised portion of the edge of the cutting element 1300 of FIG. 11-2.

The cutting element 1300 is similar to the cutting element 700 of FIGS. 10-1 and 10-2, and has a body 1310, a non-planar cutting face 1320 (with two outer raised regions 1332 and a central raised portion 1336), and an edge 1330 extending around a perimeter of the non-planar cutting face 1320. The height of the edge 1330 varies around the perimeter of the cutting element 1300, where the first, raised portion 1332 of the edge 1330 may extend higher than a second, depressed portion 1334 of the edge 1330. In the illustrated embodiment, the cutting element 1330 also includes the third, central raised portion 1336. The third portion 1336 may be a dome in a center of the cutting element 1300 (see FIG. 11-4), a ridge across the cutting element 1300 (compare with FIG. 13), or another shape of raised portion.

The cutting element 1300 differs from the cutting element 700 of FIGS. 10-1 and 10-2, in that the first portion 1332 may not have an edge angle less than 90° at the intersection with the bevel 1331 (or with the side surface if there is no bevel 1331). Rather, the first portion 1332 may include a generally flat portion 1335 and an optional inclined portion 1339. The edge angle of the flat portion 1335 (measured between the flat portion 1335 and the side of the cutting element 1330) may be about 90°, while the edge angle 1337 of the inclined portion 1339 may be an acute angle. The acute edge angle 1337 as measured between lines tangent to the inclined portion 1339 and the side of the cutting element 1330 is, in this embodiment, in a range that is greater than 35°, greater than 45°, or greater than 60° and up to 89°. For instance, the acute edge angle 1337 may be between 65° and 75°.

At the first portion 1332, the non-planar cutting face 1320 may be piecewise continuous. For instance, adjacent the edge 1330, the first, raised portion 1332 may start from a flat top surface and transition into a valley of the second, depressed portion 1334 (e.g., at an acute edge angle 1337 of 50° to 85°). The flat portion 1335 has been found to provide increased edge durability, and the size of the flat portion may be varied to achieve desired cutting efficiency and durability for a specific application. As shown in FIG. 11-4, the flat portion 1335 is, in some embodiments, formed as a chordal area, or chordal flat. The radial length 1333 of the flat portion 1335 (i.e., the distance between the innermost portion of the flat and the outer side surface) is, in some embodiments, in a range between 0.25 mm to 4 mm, between 0.5 mm and 2.5 mm, or between 1 mm and 2 mm. In some embodiments, the length 1333 is expressed as a percentage of the diameter of the cutting element 1300, or as a percentage of the major or minor diameter for an elliptical cutting element. For instance, the length 1333 may be in a range having a lower limit, an upper limit, or lower and upper limits including any of 2%, 5%, 8%, 10%, 13%, 17%, 20% of the diameter, or any values therebetween. In some embodiments, the length 1333 may be between 2.5% and 13.5%, between 3.5% and 7.5%, or between 5% and 10% of the diameter (or width) of the cutting element 1300.

While the flat portion 1335 has been described as a chordal area, in other embodiments, the flat portion 1335 may have other shapes. For instance, the flat portion 1335 may not extend across a full chordal width. In other embodiments, the flat portion 1335 may be annular and extend around a full or partial circumference of the cutting edge 1330. In such embodiments, the length 1333 of the flat portion 1335 may be generally constant around the full or partial circumference of the cutting edge 1330, rather than as shown in FIG. 11-4, have a variable length 1333 that is greatest at the center and which decreases toward each outer end. In still other embodiments, the length 1333 may vary around an annular or other shaped flat region 1335.

Two flat regions 1335 are shown in FIGS. 11-1 to 11-6; however, more or fewer flat regions 1335 may be used in other embodiments. For instance, in some embodiments, three or four flat region 1335 may be included and spaced at equal or unequal angular intervals along the circumference of the cutting edge 1330. In other embodiments, a single flat region may be used (e.g., an annular flat region). In still other embodiments, the flat regions 1335 may be described in terms of the amount of circumferential coverage provided to the cutting edge 1330, rather than the number of flat regions. For instance, as shown in FIG. 11-4, one of the flat regions 1335 may extend provide circumferential coverage 1338 to between 40° and 60° of the cutting edge 1330. The two flat regions 1335 may therefore provide coverage to between 80° and 120° of the cutting edge 330 (i.e., between about 20% and about 35% of the periphery of the cutting edge 1330). As discussed herein, however, the number, length, and shape of the flat regions 1335 may vary. Thus, by increasing or decreasing the length 1333 of the flat regions 1335, or by increasing or decreasing the number of flat regions 1335, the amount of coverage could be within a range including a lower limit, an upper limit, or lower and upper limits that include any of 5%, 10%, 20%, 30%, 40%, 50%, 60%, 70%, 80%, 90%, and 100% of the cutting edge circumference or perimeter, or any values therebetween. For instance, in some embodiments, the total circumferential coverage 1338 for the one or more flat regions 1335 is greater than 20%, less than 75%, between 5% and 75%, between 10% and 50%, or between 25% and 30%.

The third, raised portion 1336 may be formed at a central region of the cutting face 1320, spaced between the two first, raised portions 1332 of the edge 1320 having a flat portion 1337 and an inclined portion 1339, in which the inclined portion of the edge angles less than 90°. The raised portion 1336 may also be spaced between the two second, depressed portions 1334 of the edge having edge angles of about 90° or greater. The raised portion 1336 may be raised and may extend a height less than, equal to, or greater than the first portions 1332 of the edge 1330. Further, the depressed portions 1334 of the edge also extend a height less than the raised portions 1332. In some embodiments, the depressed portions 1334 also extend a height less than the central raised portion 1336, but it may be greater than convex raised portions 1336 in other embodiments.

FIG. 11-6 is a schematic, cross-sectional view of the cutting element 1300 having a non-planar cutting face 1320 formed at a first end of a body 1310. The cutting element 1300 may be in a cutter pocket (not shown) and have a flat portion 1335 and an acute edge angle portion 1339 of the edge 1330 that forms a portion of the cutting edge of the cutting element. As the cutting element is engaged with and moved across a formation 1350, an engagement area 1321 of the cutting face 1320 extends the depth of cut into the formation 1350. An engagement angle 1360 is defined between the line 1355 perpendicular to the formation 1350 being cut and the line 1325 tangent to the acute edge angle portion 1339 in the engagement area 1321 of the cutting face 1320. In the embodiment shown, the engagement area 1321 of the cutting face 1320 has a partially flat and partially concave cross-sectional profile, and thus, the engagement angle 1360 varies along the depth of cut. In at least some embodiments, a flat region 1335 or other impact resistant feature on cutting edge 1330 or at the interface between the cutting edge 1330 and the non-planar cutting face 1320 has a radial length that is fully within the engagement area 1321. Stated another way, the depth of cut of the cutting face 1320 may be greater than the radial length of the flat region 1335.

According to embodiments of the present disclosure, an engagement angle 1360 formed at an acute edge angle portion of a cutting element may be positive, for example, within a range having a lower limit, an upper limit, or both lower and upper limits including any of 00, 2°, 5°, 10°, 15°, 20°, 25°, 30°, 40°, 50°, or any values therebetween, where any relatively lower value may be selected in combination with any relatively higher value. Further, in some embodiments of the present disclosure, an engagement angle 1360 varying along a depth of cut may have a difference along a non-flat portion that has a value greater than 2°, for example, up to 5°, up to 10°, or more. For example, an engagement angle formed along an engagement area having a concave cross-sectional profile 1339 may have a difference in engagement angles along the depth of cut of ranging from about 5° to about 15°, or more, depending on the radius of curvature of the concave cross-sectional profiles.

Figures 1, 12:
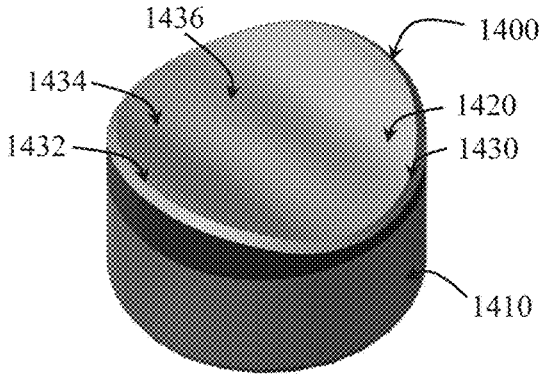
Figures 2, 12:
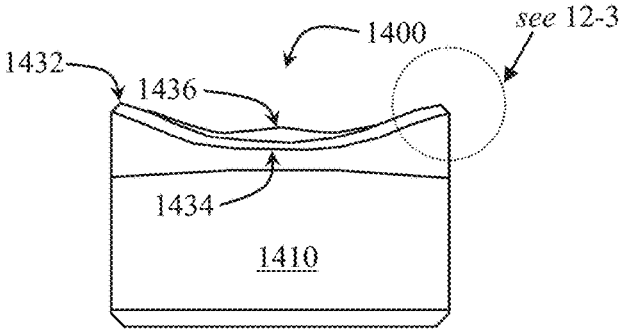
Figures 3, 12:
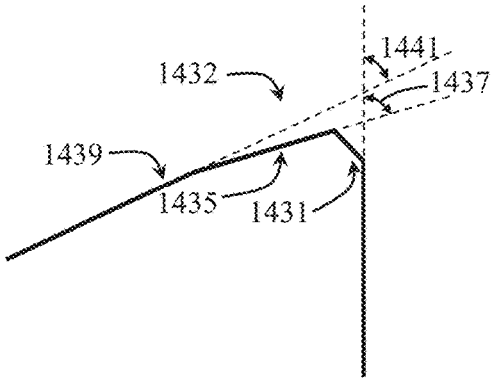

In some embodiments, a raised portion of an edge may include multiple portions, but may not include a flat portion. FIGS. 12-1 to 12-3, for instance, illustrate an example embodiment of a cutting element 1400 that includes a continuous, piecewise acute angle portion. FIG. 12-1 is a perspective view of the cutting element 1400, FIG. 12 is a side view of the cutting element 1400. FIG. 12-3 is an enlarged view of a raised portion of the edge of the cutting element 1400 of FIG. 12-2.

The cutting element 1400 is similar to the cutting element 1300 of FIGS. 11-1 to 11-4, and has a body 1410, a non-planar cutting face 1420, and an edge 1430 extending around a perimeter of the non-planar cutting face 1420. The height of the edge 1430 varies around the perimeter of the cutting element 1400, where a first, raised portion 1432 of the edge 1430 may extend higher than a second, depressed portion 1434 of the edge 1430. In the illustrated embodiment, the cutting element 1430 also includes a third, central raised portion 1436. The third portion 1436 may be a dome in a center of the cutting element 1400 as discussed with respect to cutting element 1300, may be a ridge across the cutting element (compare with FIG. 13), or may have some other shape.

The cutting element 1400 differs from the cutting element 1300 of FIGS. 11-1 to 11-5, in that the first portion 1432 has two portions 1435, 1439 that each have an edge angle 1437, 1441 that is less than 90°. In particular, a first inclined portion 1435 immediately adjacent the bevel 1431 may be inclined to be at a first acute edge angle 1437. The acute edge angle 1437 as measured between lines tangent to the first inclined portion 1435 and the side of the cutting element 1430 is, in this embodiment, in a range that is greater than 45°, greater than 60°, or greater than 70° and up to 89°. For instance, the acute edge angle 1437 may be between 60° and 89°, or between 75° and 85°. The second inclined portion 1435 may be adjacent the first inclined portion 1435, and may extend toward a recessed portion 1434. The acute edge angel 1441 of the second inclined portion 1435 is, in this embodiment, in a range that is greater than 35°, greater than 45°, or greater than 60° and up to 89°. For instance, the acute edge angle 1337 may be between 50° and 80°, or between 65° and 75°.

Figure 13:
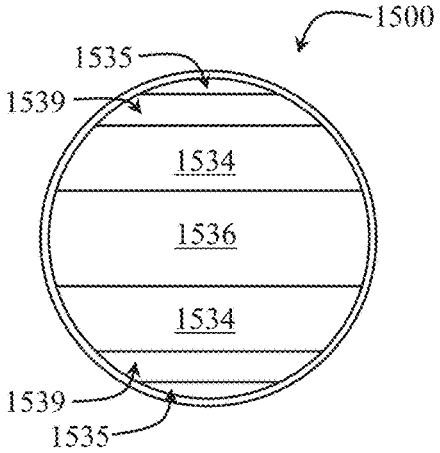
FIG. 13 is a schematic, top view of a cutting element according to embodiments of the present disclosure.

FIG. 13 is a top view of a cutting element 1500 similar to cutting elements 1300 and 1400 of FIGS. 11-1 to 12-3, and includes a non-planar cutting face that is piecewise continuous, with portions of differing heights. For instance, adjacent an edge raised portions include first and second sections 1535, 1539. The first section 1535 may be planar and at a 90° angle relative to a side of the cutting element 1500, or at an acute edge angle relative to the side of the cutting element 1500. In some embodiments, the first section 1535 is a chordal area. The second section 1539 may be an inclined section that is at a lesser edge angle relative to the side of the cutting element 1500 than is the raised portion 1535. In some embodiments, the second section 1539 is an area bounded by two chords. The chord nearer the first section 1535 may be at a higher elevation and have a shorter length as compared to the chord farther from the first section 1535. The second section 1539 may be planar, concave, convex, have other shapes, or include combinations of the foregoing.

A depressed portion 1534 of the non-planar cutting face may be between the second section 1539 and a raised central portion 1536. The raised central portion 1536 may extend across a full width of the cutting element 1500 to form a ridge. The depressed portion 1534 may also be defined by two chords. The two chords are optionally at about the same height or elevation. The depressed portion 1534 and/or the raised central portion 1534 may be planar or curved. For instance, the depressed portion 1534 may be concave, while the central portion 1534 may be convex.

Figure 14:
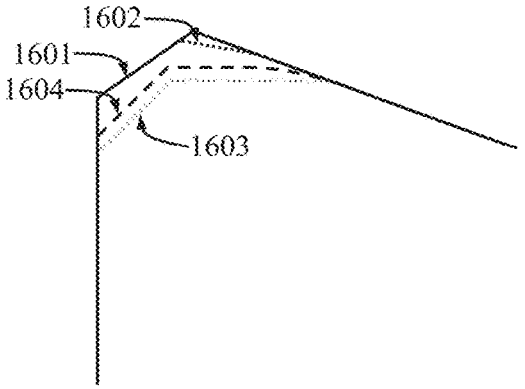
FIG. 14 is a side view of profiles of different cutting edges of cutting elements according to embodiments of the present disclosure.

Features of different embodiments described herein may be used in combination. For instance, a single cutting tool may include cutting elements of different configurations. In other embodiments, a single cutting element may include different features described herein. FIG. 14, for instance, illustrates examples of four different cutting edge profiles according to illustrative embodiments of the present disclosure. Cutting edge 1601 is similar to the cutting edge profile to the cutting edge in the embodiment described with respect to FIGS. 3, 6-1, and 6-2, and includes a bevel adjacent a raised portion defining an acute edge angle.

Cutting edge 1602 generally follows a path similar to the cutting edge 1601, and includes a bevel and a raised portion defining an acute edge angle; however, the cutting edge 1602 includes a compound, or piece-wise continuous raised portion that creates two separate angles. In this manner, the cutting edge 1602 is similar to the cutting edge of the embodiment described with respect to FIGS. 12-1 to 12-3. In some embodiments, the cutting edge 1602 may provide increased impact resistance at the cutting edge, when compared to the cutting edge 1601.

Cutting edge 1603 is similar to the embodiment described with respect to FIGS. 11-1 to 11-6 and includes a bevel adjacent a raised portion. The raised portion includes a generally flat region that transitions to an inclined region defining an acute edge angle. The inclined region may be linear or curved. The length of the flat region, angle of the inclined region, and the like may vary in accordance with different embodiments, including those disclosed herein. In embodiments tested by the Applicant of the present disclosure in which a flat region had a length between 5% and 10% of the diameter of the cutting element, and a single flat region covered between 10% and 17.5% of the circumference of the cutting element, impact resistant improved by more than 300% when compared to a cutting edge such as cutting edge 1601, that did not include a similar flat region. Accordingly, in at least some embodiments, each flat region at a cutting edge may also be referred to as an impact resistant feature.

Cutting edge 1604 is a composite cutting edge profile that combines aspects of the cutting edges 1602, 1603. In this particular embodiment, the cutting edge 1604 includes a bevel adjacent a flat region. The flat region transitions to an inclined region that itself includes a piecewise continuous, or compound portion with two or more separate angles. In some embodiments, the radially outermost inclined region adjacent the flat region may be linear in a profile or cross-sectional view, although such region may be contoured (concave, convex, wavy, etc.) in other embodiments. The radially inner portion of the inclined portion may similarly be linear or contoured in a profile or cross-sectional view.

Figure 15:
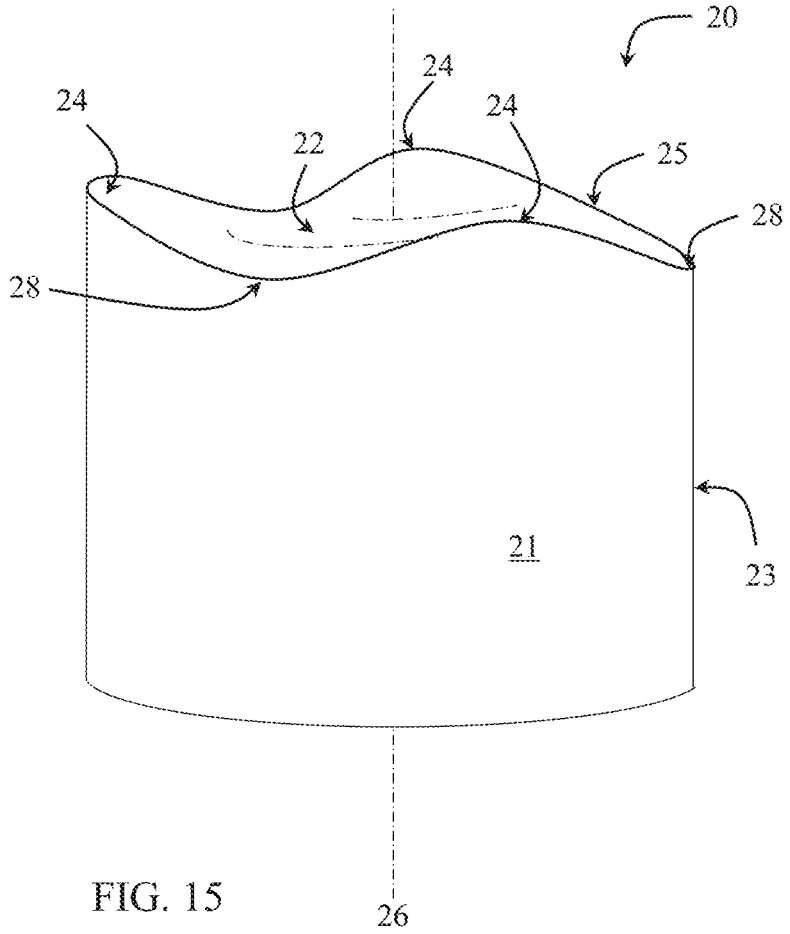
FIG. 15 shows a cutting element according to embodiments of the present disclosure.

FIG. 15 shows another example of a cutting element 20 having a non-planar cutting face 22 at a first end of the cutting element body 21, where three high portions 24 are spaced apart around the edge 25 of the cutting face 22. Each of the high portions 24 has an acute edge angle formed between the non-planar cutting face 22 and a side surface 23 of the body 21. The portions of the non-planar cutting face 22 at the high portions 24 may extend downwardly from the edge 25 and radially inward toward a central longitudinal axis 26 of the cutting element 20. The high portions 24 may be spaced apart around the edge 25 by relatively low portions 28 formed around the edge 25. A right edge angle or an obtuse edge angle may be formed between the cutting face 22 and the side surface 23 at the low portions 28.

In some embodiments, more than three relatively high portions (e.g., four high portions, five high portions or more) may be spaced apart around an edge of a non-planar cutting face on a cutting element by three or more relatively low portions of the edge, where the relatively high portions may have an acute edge angle formed between the cutting face and a side surface of the cutting element, and the relatively low portions may have edge angles greater than the edge angles of the high portions. In some embodiments, a cutting element may have a single relatively high portion formed around the edge of a non-planar cutting face, where the high portion may have an acute edge angle and the remaining portion(s) of the edge may have an edge angle greater than the edge angle of the high portion.

Figure 16:
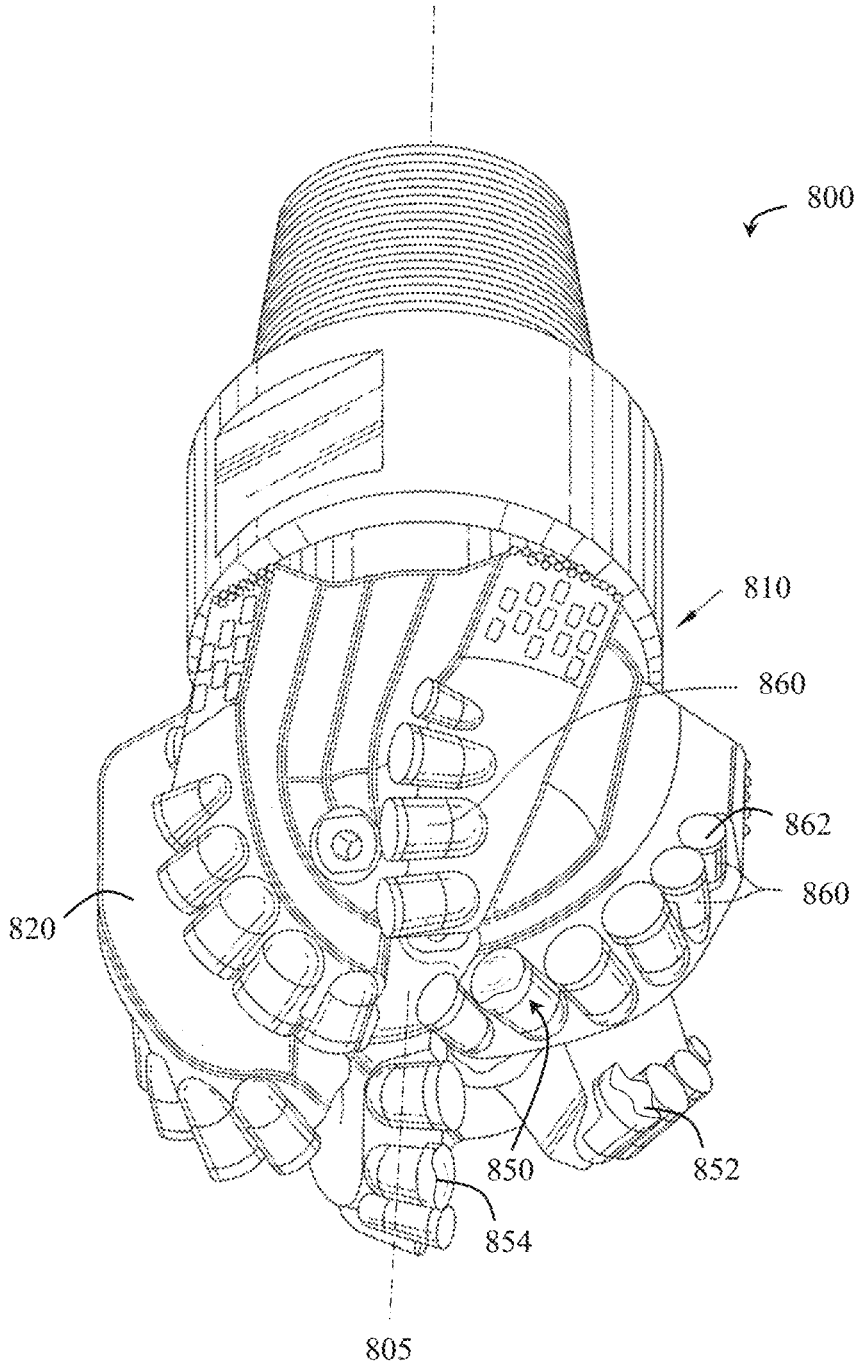
FIG. 16 shows a drill bit according to embodiments of the present disclosure.

Cutting elements according to embodiments of the present disclosure may be secured to, or otherwise positioned on a cutting tool in an orientation to have a selected effective back rake, or engagement angle. For example, FIG. 16 shows an example of a drill bit 800 having a cutting element 850 according to embodiments of the present. The bit 800 includes a bit body 810 having a longitudinal axis 805 extending therethrough and a plurality of blades 820 extending outwardly from the body 810. Cutter pockets are formed in the blades 820 in a selected orientation for receiving cutting elements. Cutting elements 860 having planar cutting faces 862 are optionally in some of the cutter pockets, and cutting elements 850 having non-planar cutting faces 852 according to embodiments disclosed herein are disposed in some cutter pockets. The non-planar cutting faces 852 include at least one acute edge angle portion 854 of the cutting element edge oriented as a cutting edge to engage a formation during drilling. According to embodiments of the present disclosure, at least one cutting element having a non-planar cutting face as disclosed herein may be on a cutting tool, such as the drill bit 800 shown in FIG. 16, to form the cutting profile of the cutting tool.

The engagement angle formed between the cutting elements 850, 860 as they engage a formation may depend on the orientation of the cutter pocket in which the cutting elements are positioned, and the surface geometry of the cutting faces 852, 862. For example, an engagement angle may be varied by varying the orientation of a cutter pocket relative to the bit (varying the angle between the line tangent to the cutter pocket side wall relative to the cutting tool axis), and/or, an engagement angle may be varied by varying the surface geometry of a non-planar cutting face (e.g., such that a selected edge angle is provided as the cutting edge). In some embodiments, an engagement angle formed between a formation and a non-planar cutting element (having different edge angles formed around the edge of the non-planar cutting face) may be varied by rotating the non-planar cutting element within a cutter pocket to provide the different edge angles of the non-planar cutting face as the cutting edge. Accordingly, non-planar cutting elements according to embodiments disclosed herein may be used to alter one or more engagement angles on a cutting profile of an already formed cutting tool. Thus, in some embodiments, rather than (or in addition to) designing or altering a cutter pocket orientation relative to the cutting tool in which the cutter pocket is formed in order to provide a selected engagement angle between a cutting element in the cutter pocket and a formation, a non-planar cutting element according to embodiments of the present disclosure may be in an already formed cutter pocket to have an edge angle oriented in the cutting edge position in the cutter pocket in order to provide the selected engagement angle. In some embodiments, non-planar cutting elements 850, 852 may have a desired engagement angle while the cutter pocket is at a back rake angle that is between 5° and 50° or between 10° and 45°. This may include non-planar cutting elements 850, 852 in the cone, nose, shoulder, or gage regions of the bit, or in any combination of the cone, nose, shoulder, and gage regions of the bit.

Figures 1, 17:
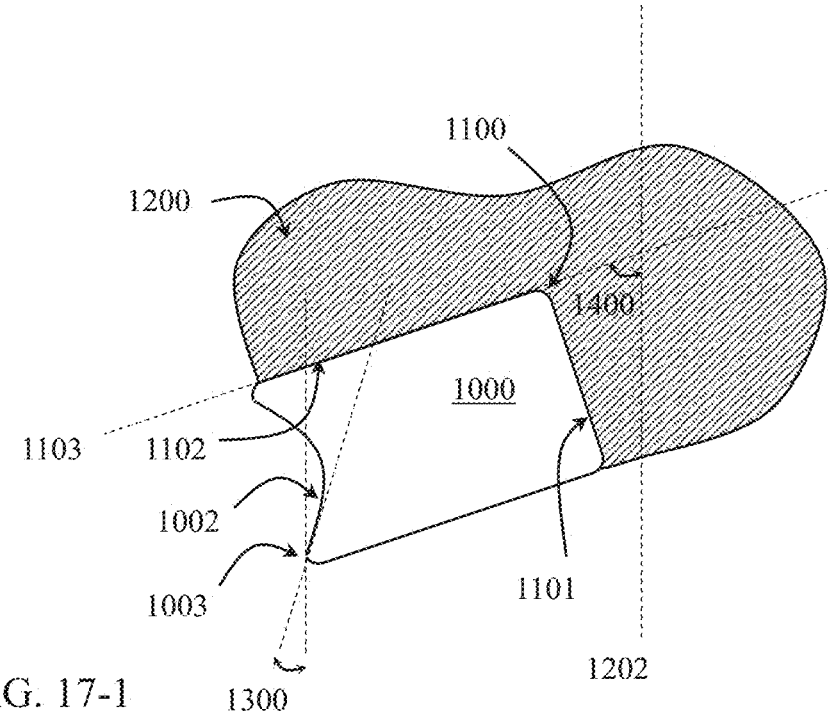
Figures 2, 17:
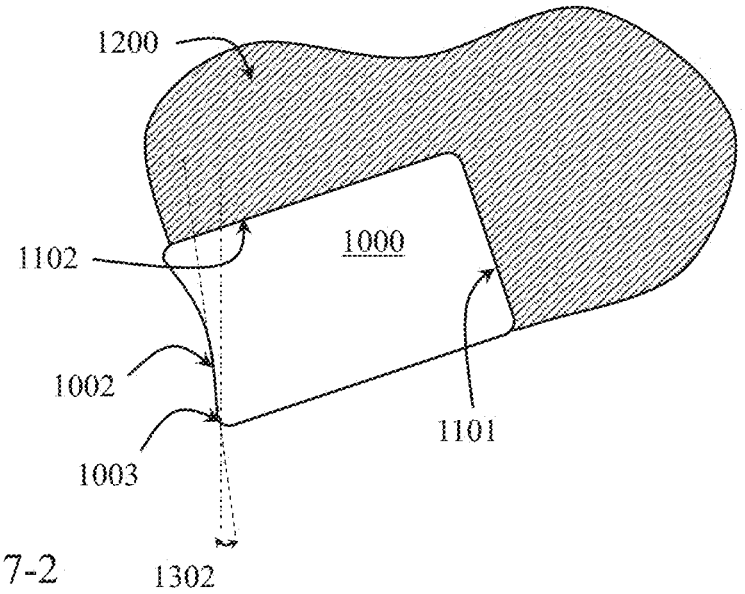

FIGS. 17-1 and 17-2 show an example of how an engagement angle may be altered using a cutting element according to embodiments of the present disclosure. In FIGS. 17-1 and 17-2, two different orientations of a cutting element 1000 within a cutter pocket 1100 are illustrated. The cutter pocket 1100 has a bottom wall 1101 (shown as interfacing a base surface of the cutting element 1000) and a side wall 1102 (shown as interfacing a side surface of the cutting element 1000) and is formed along a cutting portion of a cutting tool 1200. The cutting element 1000 has a non-planar cutting face 1002 that includes different edge angles along the perimeter of the cutting face 1002. At a first rotational orientation in the cutter pocket 1100, a first acute edge angle portion of the cutting face 1002 is positioned as a cutting edge 1003 of the cutting element, where the first acute edge angle at the cutting edge 1003 forms a positive engagement angle 1300. At a second rotational orientation in the cutter pocket 1100, a second acute edge angle portion of the cutting face 1002 is positioned as the cutting edge 1003, where the second acute edge angle at the cutting edge 1003 forms a negative engagement angle 1302. As shown, the engagement angle formed by a cutting element according to embodiments of the present disclosure may be altered within a single cutter pocket by rotating the cutting element within the cutter pocket to provide a different edge angle portion at the cutting edge. In some embodiments, a cutting element according to embodiments of the present disclosure may be rotated within a single cutter pocket from a position having an acute edge angle portion of the cutting element at the cutting edge to a position having a right edge angle portion at the cutting edge and/or to a position having an obtuse edge angle portion at the cutting edge.

Further, as shown in FIG. 17-1, a positive engagement angle 1300 may be formed by a cutting element 1000 according to embodiments of the present disclosure when the cutter pocket 1100 in which the cutting element 1000 is located would otherwise orient a conventional cutting element to have a negative back rake angle. As shown, the cutter pocket 1100 may be oriented to have a line 1103 tangent to the side wall 1102 extending at an acute angle 1400 with a longitudinal axis 1202 of the cutting tool 1200 on which the cutting element 1000 is disposed. If a cutting element having a planar surface (or having a right edge angle portion positioned to be the cutting edge) were to be in the cutter pocket 1100, the back rake angle at the cutting edge would be negative.

According to embodiments of the present disclosure, an engagement angle may be altered by rotating a cutting element according to embodiments of the present disclosure within a cutter pocket formed on a cutting tool, such as a drill bit. For example, a drill bit may include a bit body having a longitudinal axis extending there through, at least one blade extending outwardly from the bit body, a cutter pocket formed in an outermost surface of the at least one blade, the cutter pocket having a side wall and a bottom wall, wherein a line tangent to the side wall extends downwardly from the longitudinal axis at an acute angle. A non-planar cutting element may be disposed in the cutter pocket, where the non-planar cutting element may include a body, a non-planar cutting face, and a cutting edge extending around a perimeter of the cutting face, and wherein a plane tangent to a portion of the cutting face at the cutting edge forms a positive engagement angle (or effective back rake) with the longitudinal axis of the drill bit.

Figure 18:
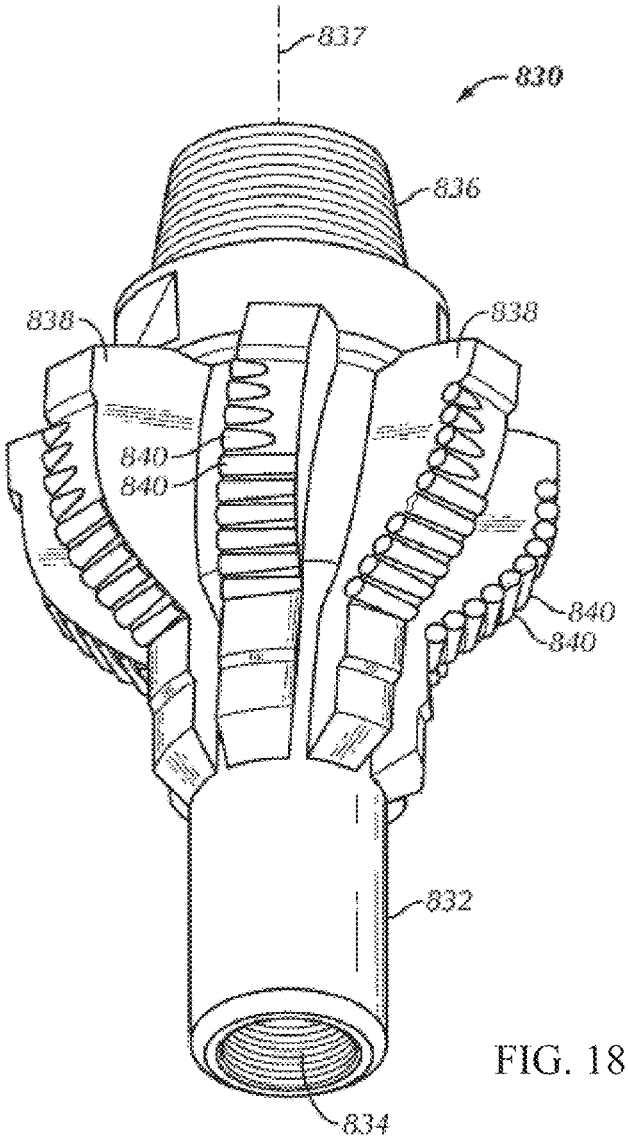
FIG. 18 shows a hole opener according to embodiments of the present disclosure.

Non-planar cutting elements according to embodiments of the present disclosure may be disposed on a variety of downhole cutting tools, including, for example, drill bits, reamers, and other hole opening tools. For example, FIG. 18 shows an example of a hole opener 830 that includes one or more cutting elements 840 of the present disclosure. The hole opener 830 includes a tool body 832 and a plurality of blades 838 disposed at selected azimuthal locations about a circumference thereof. The hole opener 830 generally includes connections 834, 836 (e.g., threaded connections) so that the hole opener 830 may be coupled to adjacent drilling tools that include, for example, a drill string and/or bottom hole assembly (BHA) (not shown). The tool body 832 generally includes a bore there through so that drilling fluid may flow through the hole opener 830 as it is pumped from the surface (e.g., from surface mud pumps (not shown)) to a bottom of the wellbore (not shown).

While embodiments of the present disclosure have been described with respect to drill bits and other cutting tools for use in downhole applications, the present disclosure is not limited to such environments, and may be used in other environments, including manufacturing, and utility line placement. Numbers, percentages, ratios, or other values stated herein are intended to include that value, and also other values that are "about" or "approximately" the stated value, as would be appreciated by one of ordinary skill in the art encompassed by embodiments of the present disclosure. A stated value or terms such as "about," "approximately," "generally," and the like, should therefore be interpreted broadly enough to encompass values, orientations, or features that are at least close enough to the stated value, orientation, or feature to perform a desired function or achieve a desired result. Stated values, features, and orientations include at least the variation to be expected in a suitable manufacturing or production process, and may further include deviations that are within 5%, within 1%, within 0.1%, or within 0.01% of a stated value, orientation, or feature. Where a range of values includes various lower or upper limits, any two values may define the bounds of the range, or any single value may define an upper limit (e.g., up to 50%) or a lower limit (at least 50%).

While embodiments of the present disclosure have been described with respect to the provided drawings, those skilled in the art, having benefit of this disclosure, will appreciate that other embodiments can be devised which do not depart from the scope of the present disclosure and the claims. Accordingly, the scope of the claims should include not only the embodiments disclosed but also such combinations of features now known or later discovered, or equivalents within the scope of the concepts disclosed and the full scope of the claims to which applicants are entitled to patent protection.

What is claimed is:

1. A cutting element, comprising:
a substrate; and
a cutting layer on the substrate, the cutting layer defining a cutting edge, a non-planar cutting face opposite the substrate, and at least one impact resistant feature at an interface between the cutting edge and the non-planar cutting face, wherein the at least one impact resistant feature extends around less than 75% of a perimeter of the cutting edge, the non-planar cutting face including at least two raised portions including:
a central raised portion; and
a first raised edge portion comprising:
a first section nearest the cutting edge forming at least a portion of the at least one impact resistant feature, wherein the first section has a first edge angle with a side surface of the cutting layer; and
a second section adjacent the first section having a second edge angle less than the first edge angle.

2. The cutting element of claim 1, wherein the first edge angle defines an acute angle with the side surface of the cutting layer.

3. The cutting element of claim 2, the central raised portion defining an obtuse angle with the side surface of the cutting layer.

4. The cutting element of claim 1, the first section of the first raised edge portion having a radial length that is between 5% and 10% of a width of the cutting layer.

5. The cutting element of claim 4, the first section of the first raised edge portion extending around between 10% and 50% of the perimeter of the cutting edge.

6. The cutting element of claim 2, the edge angle of the second section being between 60° and 75°.

7. The cutting element of claim 1, the non-planar cutting face including:
the central raised portion across a full width of the cutting element;
the first raised edge portion spaced apart from the central raised portion by a first depressed portion; and
a second raised edge portion spaced apart from the central raised edge portion by a second depressed portion.

8. The cutting element of claim 7, a cross-sectional profile of the non-planar cutting face having a sinusoidal shape on a plane extending along and intersecting a central longitudinal axis of the cutting element, the first raised edge portion, and the second raised edge portion.

9. The cutting element of claim 1, wherein the cutting edge comprises a high portion and a low portion, the first raised edge portion being located at the high portion a first height from the low portion, the central raised portion being located at a second height from the low portion, and the first height of the first raised edge portion is greater than the second height of the central raised portion.

10. The cutting element of claim 1, wherein the first raised edge portion provides circumferential coverage to between 40° to 60° of the cutting edge.

11. The cutting element of claim 1, the first section of the first raised edge portion forms a chordal area.

12. A cutting element, comprising:
a substrate; and
a cutting layer on the substrate, the cutting layer defining a cutting edge, a non-planar cutting face opposite the substrate, and at least one impact resistant feature at an interface between the cutting edge and the non-planar cutting face, wherein the at least one impact resistant feature extends around less than 75% of a perimeter of the cutting edge, the non-planar cutting face including at least two raised portions including:
a central raised portion; and
a raised edge portion spaced apart from the central raised portion by a depressed portion, the raised edge portion including at least one flat region defining a planar portion of the cutting face.

13. The cutting element of claim 12, the at least one flat region having a radial length that is between 0.25 mm to 4 mm.

14. The cutting element of claim 12, the at least one flat region extending around between 10% and 50% of the perimeter of the cutting edge.

15. The cutting element of claim 12, wherein the raised edge portion provides circumferential coverage to between 40° to 60° of the cutting edge.

16. The cutting element of claim 12, wherein the raised edge portion includes an inclined portion having an acute edge angle with a side surface of the cutting layer, the inclined portion is between the at least one flat region and the depressed portion, and the acute edge angle is greater than 60°.

17. The cutting element of claim 12, wherein the cutting edge comprises a high portion and a low portion, the raised edge portion being located at the high portion a first height from the low portion, the central raised portion being located at a second height from the low portion, and the first height of the raised edge portion is greater than the second height of the central raised portion.

18. The cutting element of claim 17, the central raised portion comprising a dome.

19. The cutting element of claim 12, the at least one flat region forms a chordal area.

20. A cutting element, comprising:
a substrate; and
a cutting layer on the substrate, the cutting layer defining a cutting edge, a non-planar cutting face opposite the substrate, and at least one impact resistant feature at an interface between the cutting edge and the non-planar cutting face, wherein the at least one impact resistant feature extends around less than 75% of a perimeter of the cutting edge, the non-planar cutting face including at least three raised portions including:
a central raised portion;
a first raised edge portion spaced apart from the central raised portion by a first depressed portion, the first raised edge portion including at least one flat region defining a planar portion of the cutting face, the at least one flat region forming the at least one impact resistant feature; and a second raised edge portion spaced apart from the central raised portion by a second depressed portion.

* * * * *